US007635261B2

(12) United States Patent
High et al.

(10) Patent No.: US 7,635,261 B2
(45) Date of Patent: Dec. 22, 2009

(54) LARGE PALLET MACHINE FOR FORMING MOLDED PRODUCTS

(75) Inventors: Douglas Vernon High, Vancouver, WA (US); Stacy L. Gildersleeve, Woodland, WA (US); Daniel Richard Wahlstrom, Vancouver, WA (US); Llewellyn Lee Johnston, Vancouver, WA (US); Keith Donald Brewer, Clackamas, OR (US)

(73) Assignee: Columbia Machine, Inc., Vancouver, WA (US)

( * ) Notice: Subject to any disclaimer, the term of this patent is extended or adjusted under 35 U.S.C. 154(b) by 647 days.

(21) Appl. No.: 11/341,049

(22) Filed: Jan. 27, 2006

(65) Prior Publication Data

US 2006/0182840 A1 Aug. 17, 2006

Related U.S. Application Data

(60) Provisional application No. 60/648,018, filed on Jan. 27, 2005.

(51) Int. Cl.
*B28B 1/087* (2006.01)

(52) U.S. Cl. ..... 425/255; 425/421; 425/424; 425/432; 425/456

(58) Field of Classification Search ..... 425/421, 425/424–425, 432, 456, 410, 253–255
See application file for complete search history.

(56) References Cited

U.S. PATENT DOCUMENTS 2,294,339 A 8/1942 Hoffman et al.

(Continued)

FOREIGN PATENT DOCUMENTS

DE 972488 11/1959

(Continued)

OTHER PUBLICATIONS

Dr. Helmut Strumpfel, Weimar, Multifrequency Contrarotation Vibrator, Betonwerk+Fertigteil-Technik, Oct. 1988, pp. 48-50, German.

(Continued)

*Primary Examiner*—Yogendra Gupta
*Assistant Examiner*—Thu Khanh T Nguyen
(74) *Attorney, Agent, or Firm*—Marger Johnson & McCollom, P.C.

(57) ABSTRACT

A concrete products forming machine including a main frame, feed drawers, die supports and mold and head assemblies. The feed drawer is moved into position over the mold using an electric belt drive system and includes a vibrating strike off plate to improve surface quality of the molded product, zoned agitators to control movement and placement of concrete, a spring loaded seal system between the walls and floor of the feed box, and quick-release agitator design with urethane sleeves to effect easy and clean removal, replacement and cleaning of the agitators. The concrete products forming machine includes torque tube and leaf spring supports to effect substantially vertical vibrational movement of the mold with air inflatable springs for controlled force between the mold bottom and the pallet. The pallet itself is vibrated from below using phased, counter rotating shafts coupled to the pallet table on which the pallet rests. Vibration induced into the pallet by the vibrating pallet table is transferred to the mold resulting in material compaction. After the molding process, the mold is lifted in a stripping process to remove the molded product for curing or drying.

32 Claims, 17 Drawing Sheets

U.S. PATENT DOCUMENTS

| | | | | |
|---|---|---|---|---|
| 3,764,242 | A * | 10/1973 | Fischer | 425/427 |
| 3,918,298 | A | 11/1975 | Petersen | |
| 4,238,177 | A | 12/1980 | Crile et al. | |
| 4,830,597 | A | 5/1989 | Steier | |
| 5,005,439 | A | 4/1991 | Jensen | |
| 5,355,732 | A | 10/1994 | Anderl | |
| 5,496,132 | A * | 3/1996 | Pelletier | 425/456 |
| 5,807,591 | A | 9/1998 | Aaseth | |
| 7,025,583 | B2 * | 4/2006 | Bald | 425/432 |

FOREIGN PATENT DOCUMENTS

| | | |
|---|---|---|
| DE | 1558839 | 6/1970 |
| DE | 7613723 U | 12/1976 |
| DE | 3709112 | 3/1987 |
| DE | 3708922 | 9/1988 |
| EP | 0092014 | 10/1983 |
| EP | 0337040 | 10/1989 |
| GB | 8228664 | 4/1984 |
| SU | 1283-571 A | 1/1987 |
| SU | 1610-360 A | 11/1990 |

OTHER PUBLICATIONS

Von Dr.-Lng R. Sonnenberg, Kaarst, Vibratory Compaction in block machines, Betonwerk+Fertigteil-Technik, Heft Aug. 1979, pp. 478-485, German.

Siemens, Equipment for Processing Machines WF 746 Synchronized Assembly, Jul. 1991, Germany.

Siemens, Equipment for Processing Machines WF 746 Synchronized Assembly, Jul. 1991, Germany. Abstract prepared by translator retained by applicants' attorney.

Stoff et al., DE972488, Vibratory Conveyors or Sieves, Nov. 12, 1959, Germany. Abstract prepared by translator retained by applicants' attorney.

Heinz et al., DE1558839, Vibratory Drive by the Use of Two Self-Synchronizing, Counter Running Imbalances, Jun. 11, 1970, Germany. Abstract prepared by translator retained by applicants' attorney.

* cited by examiner

LARGE PALLET MACHINE FOR FORMING MOLDED PRODUCTS

CROSS-REFERENCES TO RELATED APPLICATIONS

This application claims the benefit from U.S. Provisional Patent Application No. 60/648,018 filed Jan. 27, 2005 whose contents are incorporated herein for all purposes.

BACKGROUND OF THE INVENTION

1. Field of the Invention

This invention relates generally to concrete product making machinery and more particularly to a method and apparatus for high speed manufacturing of a wide variety of high quality products.

2. Description of the Prior Art

Prior art machines for forming concrete products within a mold box and include a product forming section comprising a stationary frame, an upper compression beam and a lower stripper beam. The mold box includes a head assembly that is mounted on the compression beam, and a mold assembly that is mounted on the frame and receives concrete material from a feed drawer. An example of such a system is shown in U.S. Pat. No. 5,807,591 which describes an improved concrete products forming machine (CPM) assigned in common to the assignee of the present application and herein incorporated by reference for all purposes.

In use, the feed drawer moves concrete material over the top of the mold assembly and dispenses the material into the contoured cavities of the mold assembly. The feed drawer typically includes an agitator assembly within the drawer that operated to break up the concrete and improve its consistency prior to dropping it into the mold. As the concrete material is dispensed, a vibration system shakes the mold assembly to spread the concrete material evenly within the mold assembly cavities in order to produce a more homogeneous concrete product. A wiper assembly, mounted to the front of the feed drawer, acts to scrape excess concrete from the shoes when the feed drawer is moved to an operative position above the mold assembly.

After the concrete is dispensed into the mold cavities, the feed drawer retracts from over the top of the mold assembly. A spreader, bolted separately to the front of the feed drawer, scrapes off excess concrete from the top of the mold when the feed drawer is retracted after filling the mold cavities. The compression beam then lowers, pushing shoes from the head assembly into corresponding cavities in the mold assembly. The shoes compress the concrete material during the vibration process. After compression is complete, the stripper beam lowers as the head assembly pushes further into the cavities against the molded material. A molded concrete product thereby emerges from the bottom of the mold assembly onto a pallet and is conveyed away for curing and a new pallet moved in its place beneath the underside of the mold assembly.

Several drawbacks have been identified with these prior concrete products forming machines. First, it has traditionally been quite time consuming to change mold and corresponding shoe assemblies so that new product configurations can be produced in the machine. Accordingly, manufacturing efficiency is reduced. Second, prior art vibration systems are known to impart slightly horizontal vibrational forces which cause the shoes to impact against the interior of the mold cavities when inserted. This results in increased wear on these parts with early and costly replacement necessary. Third, the process of moving of concrete material from the feed box to the mold cavities is a fairly messy procedure. Again, efficiency and product quality is reduced due to the requirement of frequent clean-ups.

Finally, prior art concrete products forming machines have traditionally been produced using hydraulic power systems which are noisy, energy inefficient, requires high maintenance, are messy, and are unwieldy with hoses and tubes routed through and around the machine.

Accordingly, there is a need for a high output concrete product forming machine that efficiently adapts to making a wide variety of high quality products, is energy efficient, avoids oil leakage exposure and contamination, requires minimal maintenance, and is easily serviced.

SUMMARY OF THE INVENTION

A concrete products-forming machine constructed according to aspects of the invention has several novel features which can each be implemented together or in-part to yield an improved apparatus.

The apparatus includes a means for vibrating the pallet table directly along with a novel means for maintaining the vibration in a generally vertical direction to reduce impacts of the mold shoes with the inside of the mold cavities. The vibration direction control means includes pairs of leaf spring-like parallel bars, coupling the die supports to the main frame, and a torsion bar, coupling the die supports to each other. Air springs, mounted within the die supports and acting as shock absorbers for the vibrating mold box, are inflated as needed to control the stiffness of the shock-absorbing means.

A mold assembly, comprised of mold head assembly with shoes, and the mold is changed out of the machine using an automatic mold transfer feature characterized by a carriage with two pivoting wings with a hook on each end that engages with bars located on either side of the head assembly. The head assembly and mold is automatically unfastened and lifted from off the die supports and transferred under programmed control onto a mold staging location. Another mold assembly may be automatically moved and inserted into the machine in a similar manner. Engagement and disengagement of the mold with the die supports is accomplished by using automatic torque drivers that thread and unthread nuts onto bolts protruding through the die supports. Engagement of the mold head assembly to the compression beam head assembly is accomplished by using a key slot design in the head assembly and a corresponding pneumatic puck assembly mounted on the compression beam to allow positive engagement of the head assembly when the mold is properly positioned within the machine. The automated nut drivers, have magnets located within the rotational sockets that interface with the nuts so that disengaged nuts are maintained within the socket when taken off from the die support bolts and then reused to engage another head assembly.

An additional novel feature is the use of an air knife to produce an air stream between the feed drawer bottom plate and the edge of the mold to prevent material from falling into the gap between the two elements. Air is forced under pressure through a slot having an approximate length of the interface between the mold box and the feed drawer. This air flow creates an upward airstream that results in closing the gap, greatly reducing material from falling through the opening between the mold and the feed drawer bottom plate.

The vibration mechanism used to compact the product includes four shafts running parallel to one another underneath the pallet table. Each shaft includes an off-center weight mounted thereon. The two outer shafts counter-rotate and phase with one another; the two inner shafts counter-rotate and phase with one another. When the phase difference is zero, maximum vibration arises. When the phase difference between the inner sets and the outer sets is 180 degrees, there is no vibration. Accordingly, vibration may be controlled simply by phasing the weights rather than varying the rotational speed of the shafts. In a preferred embodiment, the phase is changed only on two weights by either speeding up or slowing down the rotation of those two shafts momentarily to shift into a new phase.

The vibration mechanism is coupled to a series of vertical bars on which the pallet sits. Vibratory forces, imparted from the rotating counterweights mounted to the underside of the pallet table transfer the vibratory forces through the pallet and into the mold box by impacting upward into the pallet and the mold box frame. The mold box then vibrates in a generally vertical direction by action of the leaf spring parallel bars and torsion bar as described above. This is a reversal of the prior methods for shaking the mold box to increase material density and remove voids in the concrete where the die supports on which the mold rests are vibrated rather than the pallet table on which the bottom of the pallet rests.

The feed drawer that transports concrete material to the mold is moved horizontally using a belt system powered by an electric drive. The belt includes molded teeth that engage with complementary formed teeth on the belt drive sheaves. The feed drawer includes a set of clamps for the purpose of attaching the feed drawer to the belt drive. The belt drive moves the feed drawer horizontally along tracks toward and away from the mold assembly.

Another novel feature of the present apparatus is the use of a vibrating strike-off plate that is dragged over the top of the now-filled mold to wipe away excess concrete. A set of vibrators, one at each end of the strike-off plate are initiated to run during the return cycle of the feed drawer. This vibrating motion of the strike-off plate acts like a screed and assists in minimize scalping of material left on top of the mold.

Yet another novel feature is the use of a spring activated seal formed between the moveable feed drawer and the stationary plate on which it sits. A set of seal bars located on the sides and at the rear of the feed drawer act as seal between the feed box and the feed drawer bottom plate to contain the concrete material within the feed box. These replaceable bars are mounted in a manner that allows a series of springs to apply pressure pushing the seal bar against the feed drawer bottom plate. This spring movement allows the bar to remain against the bottom even as wear occurs.

Rotary agitators are included within the feed drawer and affixed at their ends to drive mechanisms on the sides of the feed drawers. The agitators include rods or paddles that mix the concrete material to keep the material from solidifying and to also drive the material in the desired direction (e.g., toward the mold box when the feed drawer moves over the top of the mold cavities). Each end of the agitator has a square cross-section and is received in complementary slots designed into the drive mechanism. A sleeve is then fitted over each end and positioned over the slot in the drive mechanism to maintain the agitator within the feed box. The drive mechanism is driven by an electric motor located outside the feed box. The agitators may thus easily be installed and removed. The agitator shafts are covered with a urethane sleeve, also a novel design, that helps prevent concrete from building up on the agitators during use.

The foregoing and other objects, features and advantages of the invention will become more readily apparent from the following detailed description of a preferred embodiment of the invention that proceeds with reference to the accompanying drawings.

DETAILED DESCRIPTION

The novel features of the present invention include air spring die supports; parallel bar alignment of the die support, pallet table, and mold head plate; automatic mold and mold head installation; operation using electric drive motors utilizing servo motors for precision positioning of components and for installing and removing the retaining nuts; torsion bar interface connection of die supports; key slots for mold head installation; reduced noise resulting from the lack of a hydraulic pump; smooth operation of the electric motors; oil mist lubrication for the vibration system; positive air flow for sealing between the mold and the feed drawer; feed belt drive; rotary agitators; vibrating strike-off plate; agitators designed for easy removal and replacement; spring adjustable feed drawer side seals; and spring controlled rear seal.

Figure 1:
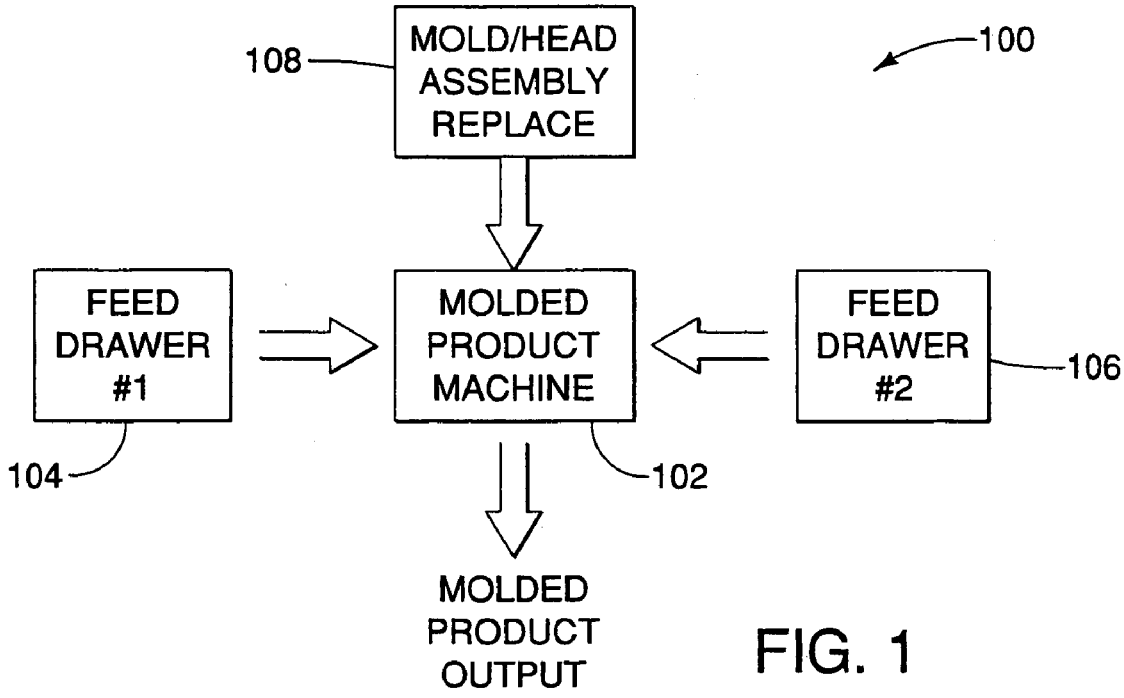
FIG. 1 is a block diagram of a large pallet machine for forming molded (e.g., concrete) products according to a preferred embodiment of the invention.

FIG. 1 shows generalized components of a large pallet machine at 100 for forming molded products, such as pavers, srw's and block formed from concrete, according to a preferred embodiment of the invention. The present invention makes reference to concrete as a material used to form the molded products, although those skilled in the art would recognize that other materials could be used without departing from the spirit of the invention.

Machine 100 includes a center section 102 in which the product is formed in molds. Machine 100 further includes one or more feed drawers 104, 106 in which feed material (e.g., concrete) is maintained prior to delivery to the molds within center section 102. Feed drawer 104 is referred to as a primary feed drawer and feed drawer 106 as a secondary feed drawer. As will be explained further, the primary feed drawer 104 moves right and dumps concrete into the center section. If the molded product includes a colored cap, as is common with certain types of paver products where the color and/or surface texture of a top exposed surface of the molded product is important for aesthetics, the alternate mix can be kept in secondary feed drawer 106 and fed to the center section after the grey concrete mix from primary feed drawer 104. With twelve inch height molds used in center section 102, each feed drawer will generally be designed to hold twenty cubic feet of material.

A final element of the large pallet machine 100 is a robotic gantry, characterized with mold/head replacement completed by a mold transfer system 108, which installs different molds within the large pallet machine center section 102 from a mold/head storage table. Those knowledgeable in the art would recognize that the mold and head assemblies are matched as two complementary portions of the molding process with the mold including cavities into which moldable product is placed and the head assembly including shoes lowered into the cavities to compact the material within the cavities. Accordingly, the mold and head assemblies are moved together in machine 100 during any mold replacement action conducted by the mold transfer system 108. Further information about mold transfer system 108 is disclosed in reference to FIGS. 9-11 below.

Molded product is shown output in a downward direction away from the feed drawer 104, drawer 106, and the mold transfer system 108. It is understood, however, that product may be output in any direction and is not so limited as shown in FIG. 1.

Figure 2:
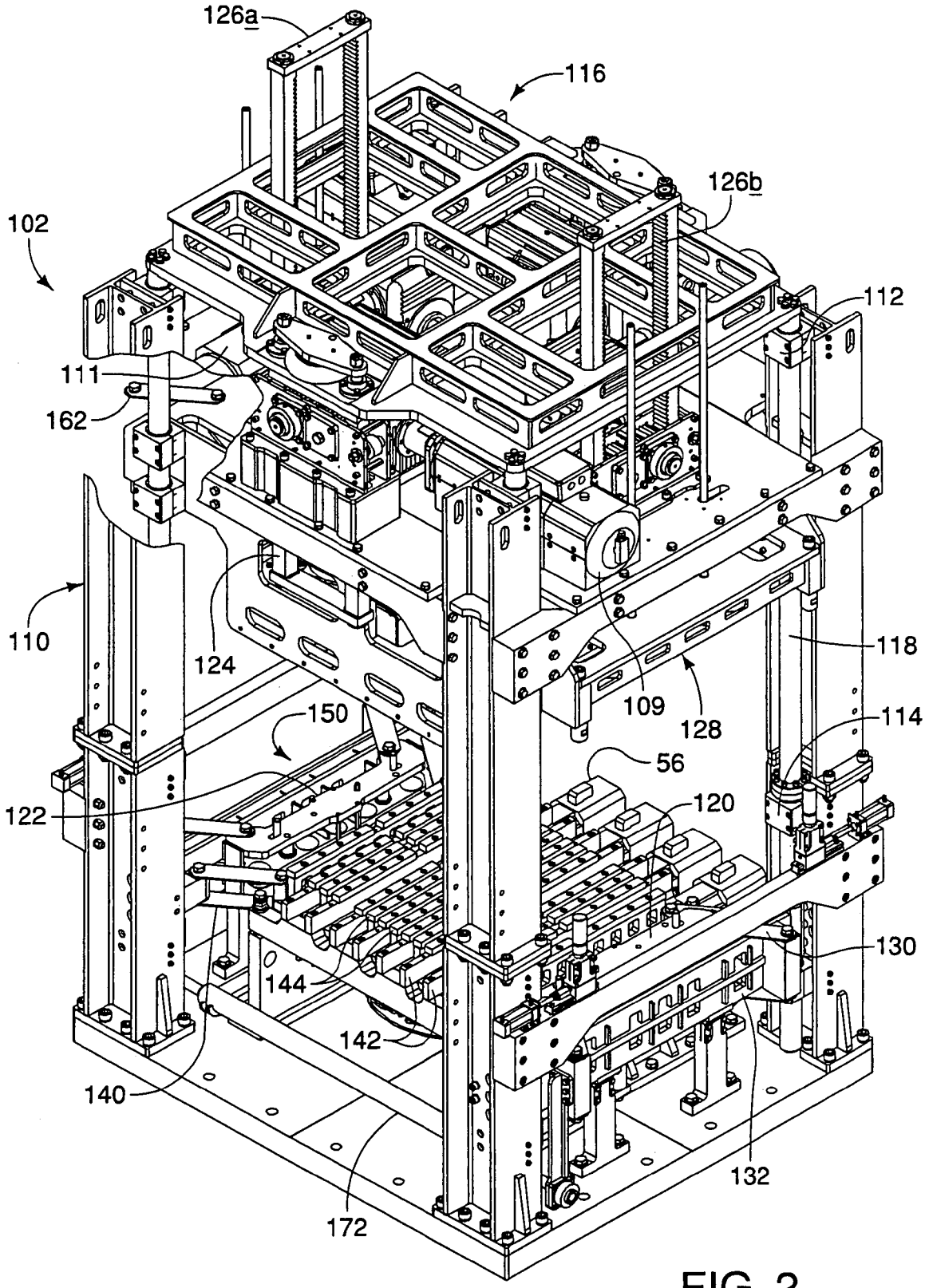
FIG. 2 shows a perspective view of the center section of the large pallet machine constructed according to a preferred embodiment of the invention.

FIG. 2 shows a perspective view of the center section 102 of the large pallet machine 100 constructed according to a preferred embodiment of the invention. For clarity, the center section is shown without mold and head assembly installed. In general use according to methods well known in the art, a mold assembly is positioned within center section 102 of machine 100 for use. The mold assembly is formed of a mold and complementary head assembly that includes "shoes" that fit within each of the mold cavities formed within the mold. The head assembly is mounted on an overhead and vertically moveable structure called a compression head which removes the head assembly shoes from within the mold cavities, thus allowing the cavities to be filled with concrete, and then lowering the shoes back into the now-filled cavities to compress the concrete with the density and shape defined by the mold cavities. A stripper beam is mounted within the center section to move the mold upward separately from a pallet beneath the mold so that molded product is released from within the cavities onto the pallet—a process called "upstripping"—or moves the pallet itself downward in cooperation with the shoes on the compression head to force molded product out the bottom of the mold.

The center section includes two electric motor pairs 109, 111, each of which operates a different set of rack and pinions, one pair for moving the stripper beam 116 up and down and the other pair for moving the compression beam 128 up and down. The center section main frame 110 is securely anchored to a steel support frame that is poured into a large concrete pad. The stripper beam frame, upon which the mold box is mounted, moves vertically along guides 112, 114. The stripper beam 116 is supported by four vertical posts, like post 118, with the lower end of the post having die supports 120, 122 mounted thereon. When the motors controlling rack and pinion 124 and the opposing rack and pinion (not shown) are actuated, stripper beam 116 and posts 118 connected thereto move vertically to thereby move the die supports 120, 122 and hence the mold box mounted on the die supports vertically. Rack and pinion 126*a* (and opposing rack and pinion 126*b*) similarly moves compression beam 128 in the same fashion.

A well-recognized problem with forming molded products, especially those formed out of viscous concrete material, is the presence of voids or air pockets and the inconsistent compaction within the material used to form the molded product that reduces the structural integrity of the product when the product dries. It is desired to even out the material within the molds to eliminate these inconsistencies in the finished, molded product. The primary method for accomplishing this is by agitating the product through vibration. In prior art systems, such as U.S. Pat. No. 5,395,228 owned in common with the present application, a single drive shaft is used to impart vibration to the die supports on which the mold sits. One recognized drawback with existing vibrating systems is that vibration occurs not only vertically, but also laterally. Accordingly, the mold cavity walls impact against the shoes that are received within the mold during compaction and stripping thereby creating undue wear on the equipment. A need exists, therefore, for methods and systems that limit vibration movement to a primarily vertical direction.

Mold Vibration Control

In the present invention, vibration is controlled using a novel vibration mechanism, shown generally in FIG. 2 as vibration table 134, and a vibration direction control apparatus, shown generally in FIG. 2 at 150. These elements are shown in more detail, respectively, with reference to FIGS. 5-6 and FIG. 7. Vibration control is important with respect to three main features of the machine 100: the vibration table 134, the supports 120, 122 upon which the mold rests, and the compression beam 128 to which the shoes of the head assembly are attached. Each of these elements are fitted, in a preferred embodiment of the invention, with four pairs of springs, like springs 130, 132, that restrict the die support to only vertical motion for reasons which will be further appreciated with reference to the description below.

Figure 3:
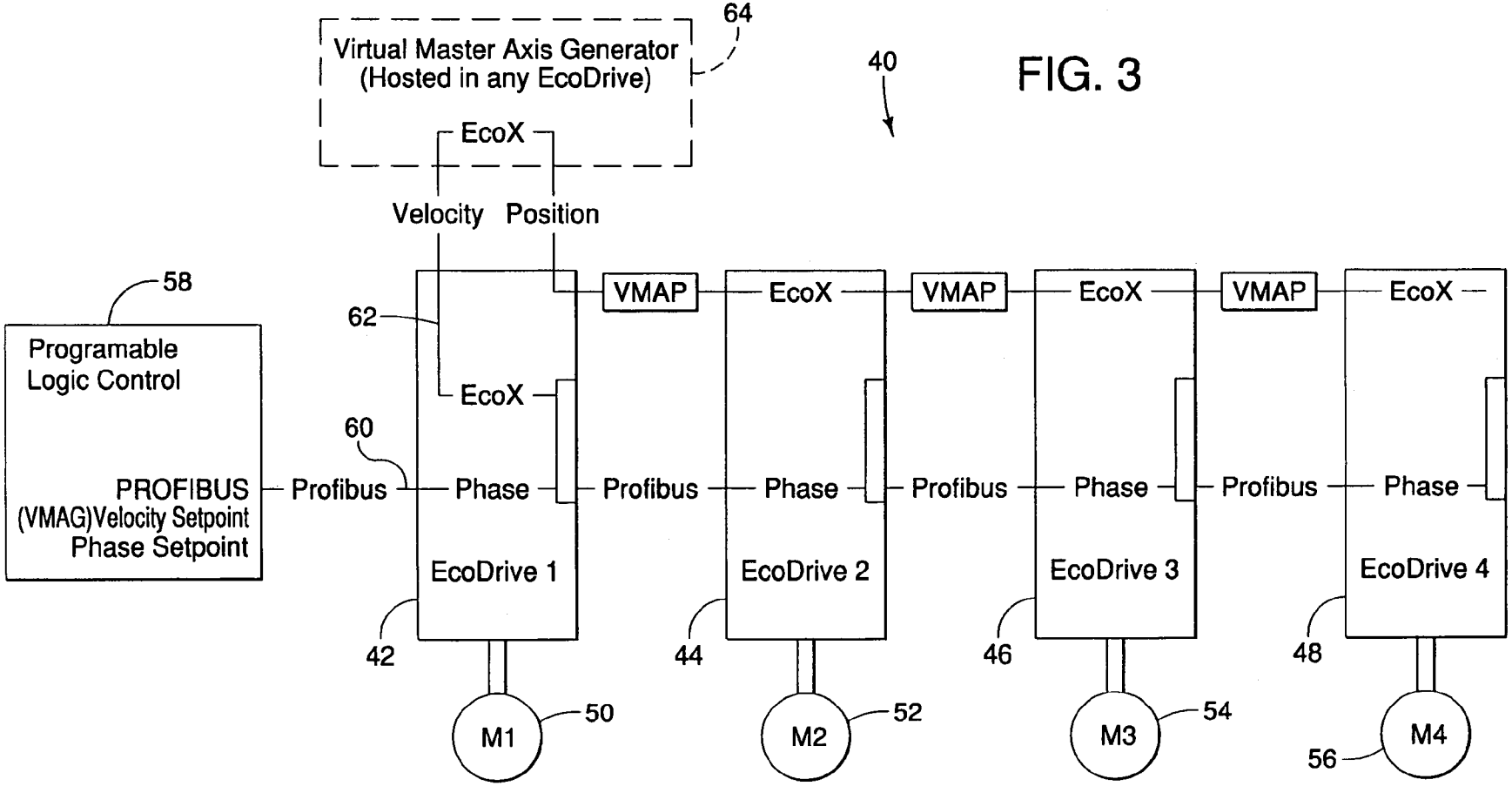
FIG. 3 is a schematic view of the electronics and control systems implemented within the vibration control system of the invention.

Indicated generally at 40 in FIG. 3 is a vibration control system that can be used for the large pallet machine of the present invention. System 40 includes digital servo controllers 42, 44, 46, 48, sold under the brand name EcoDrive. Each digital servo controller is operatively connected to an asynchronous electric motor 50, 52, 54, 56, respectively. A programmable logic controller 58 is operatively connected to each of the servo controllers via a commercially available serial communication link, in the present implementation the link being sold under the brand name Profibus. In addition, the Profibus link also communicates with another commercially available serial communication link 62, this link being sold under the brand name EcoX.

Each of the four motors 50, 52, 54, 56 operates as a slave to a virtual master axis generator (VMAG) 64, which is implemented with software that is included with each EcoDrive controller 42, 44, 46, 48. In the present embodiment, however, only one VMAG 64, which happens to reside in controller 42, is used to control all of the motors. Each motor includes a conventional encoder (not shown in the drawing) that feeds back motor position to its associated controller. As will be seen, each of the 4 motors is controlled by local feedback from the motors shaft encoder to its associated drive in response to digital information arriving via buses 60, 62.

In operation, PLC 58 may be programmed in a known manner to permit a user, using controls (not shown) on the PLC, to adjust the following motor parameters: velocity set point, acceleration, deceleration, and a position set point, sometimes referred to as phase. This information is provided in data sent via Profibus 60 and EcoX bus 62 to VMAG 64. Position information, and therefore velocity information, is transmitted by VMAG 64 on EcoX bus 62 1000 times per second to each of the four controllers. This synchronizes the velocity and phase of each motor.

An operator using the PLC 58 controls may generate a phase offset input that is transmitted on Profibus bus 60 to two of the motors. Phase is offset by the desired amount by momentarily slowing the speed of two of the motors, which are then resynchronized to the position signals on the EcoX bus. A brief description of a sequence of operational modes may help illustrate the motor control produced by system 40.

First, the PLC 58 sends a HOME command to all of drives 42, 44, 46, 48 via the EcoX bus. Two motors home at 0 degrees and two at 180 degrees. The PLC then sends a base velocity set point to VMAG 64 via busses 60, 62. All four motors accelerate with no vibration (because two sets each include counter rotating motors 180 degrees out of phase). This is responsive to the velocity/phase information distributed on bus 62 as described above. Motor acceleration and deceleration may occur responsive to stored velocity/position ramps that define the time and degree of particular acceleration/deceleration operations of the motors.

In response to a preprogrammed control in PLC 58, the PLC sends medium vibration offset information to two of the EcoDrives via bus 60. This offset information temporarily slows the speed of one motor in each counter rotating pair, thus shifting the rotational phases of the motor pairs and introducing vibration proportional to the degree of the phase shift. The motors again resynchronize, albeit in their phase shifted relationship, to the velocity/phase information on bus 62.

Next PLC 58 could send a high speed velocity set point to VMAG 64 via bus 60, followed by sending high vibration phase offset to two of the motors via bus 60. These commands are generated and transmitted in the same manner as described in connection with base velocity and medium vibration offset information.

Thereafter PLC 58 sends no vibration phase offset command thus returning the motors to 180 phase relationship and eliminating vibration. Further acceleration, deceleration, and phase offsets can be delivered as required for various frequencies and magnitudes of vibration. A person with ordinary skill in the art can implement vibration system 40 as described above.

Figure 4A:
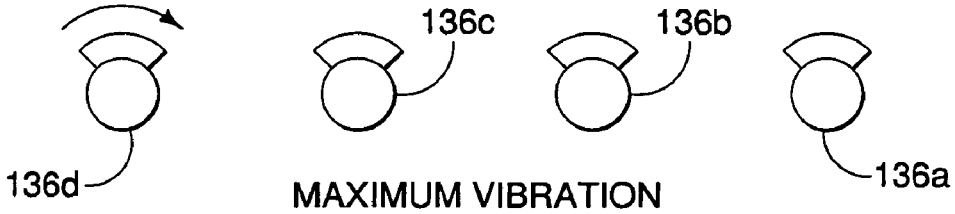
FIGS. 4A-4C show the relationship of the vibration shaft counterweights controlled by the system of FIG. 4 during maximum, minimum and mid-level amplitude respectively.
Figure 4B:
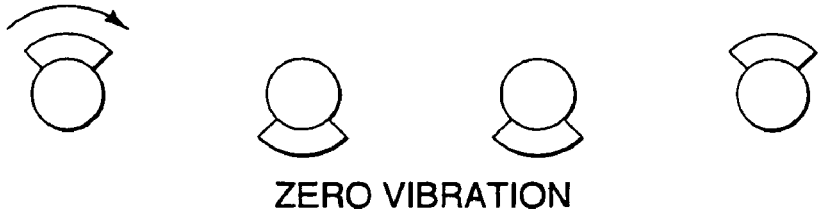
Figure 4C:
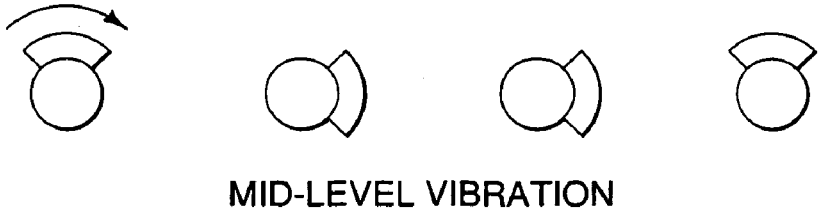

FIGS. 4A through 4C illustrate counterweight phasing controlled by the vibration control system of FIG. 3. The rotational characteristics, including speed and phase, of each of the four shafts 136*a* through 136*d* are controlled by respective motors 50, 52, 54, 56 and controllers 42, 44, 46, 48 as described above with reference to FIG. 3.

Figure 5:
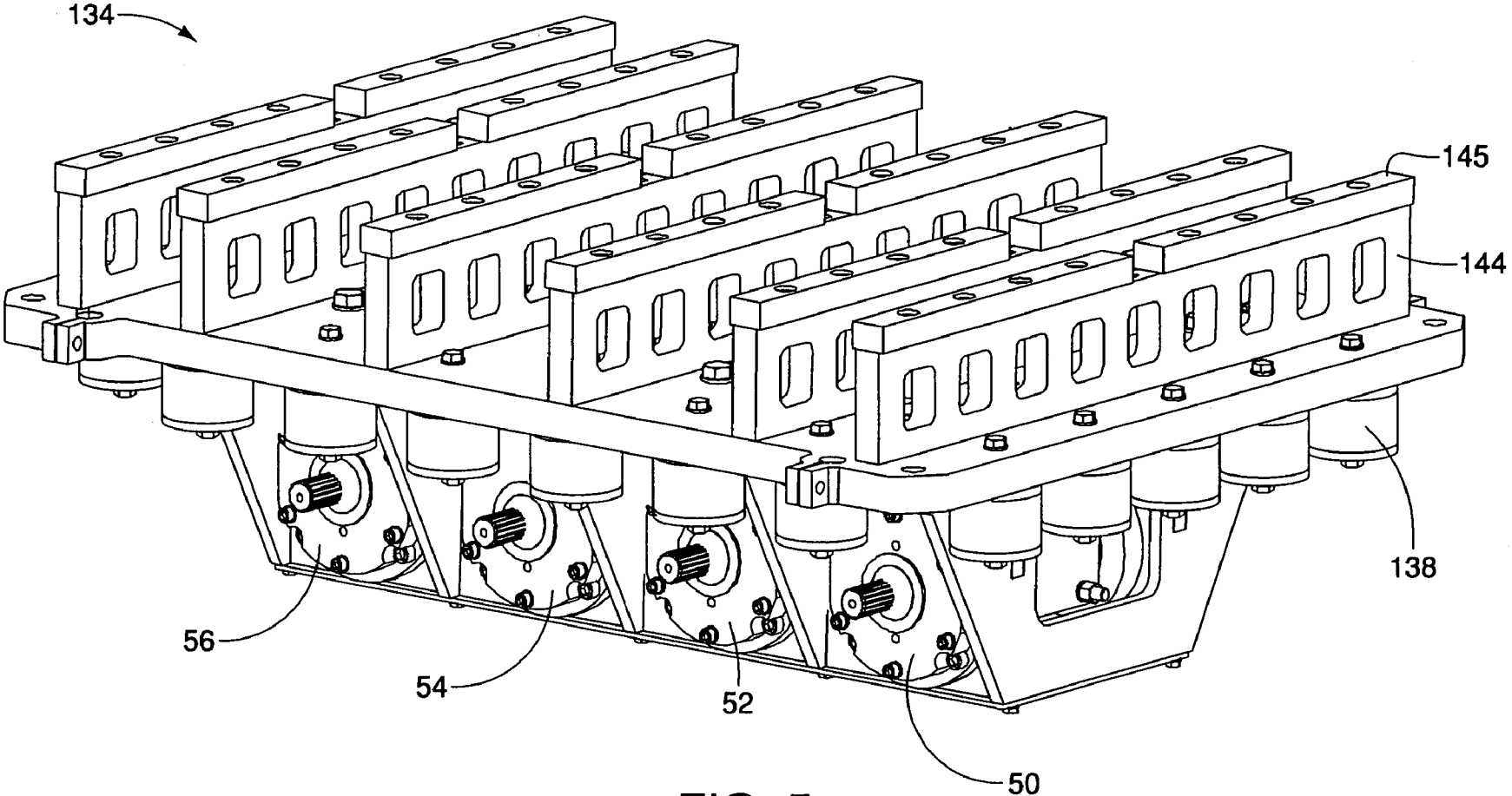
FIG. 5 is a perspective view of the pallet vibration table shown in FIG. 2 incorporating the shaft counterweight system of FIGS. 4A through 4C.

FIG. 5 shows a vibration table 134 constructed according to a preferred implementation of the invention. Vibration table 134 is shown removed from center section 102 but is normally installed between the die supports 120, 122 as in FIG. 2 as described below.

Figure 6:
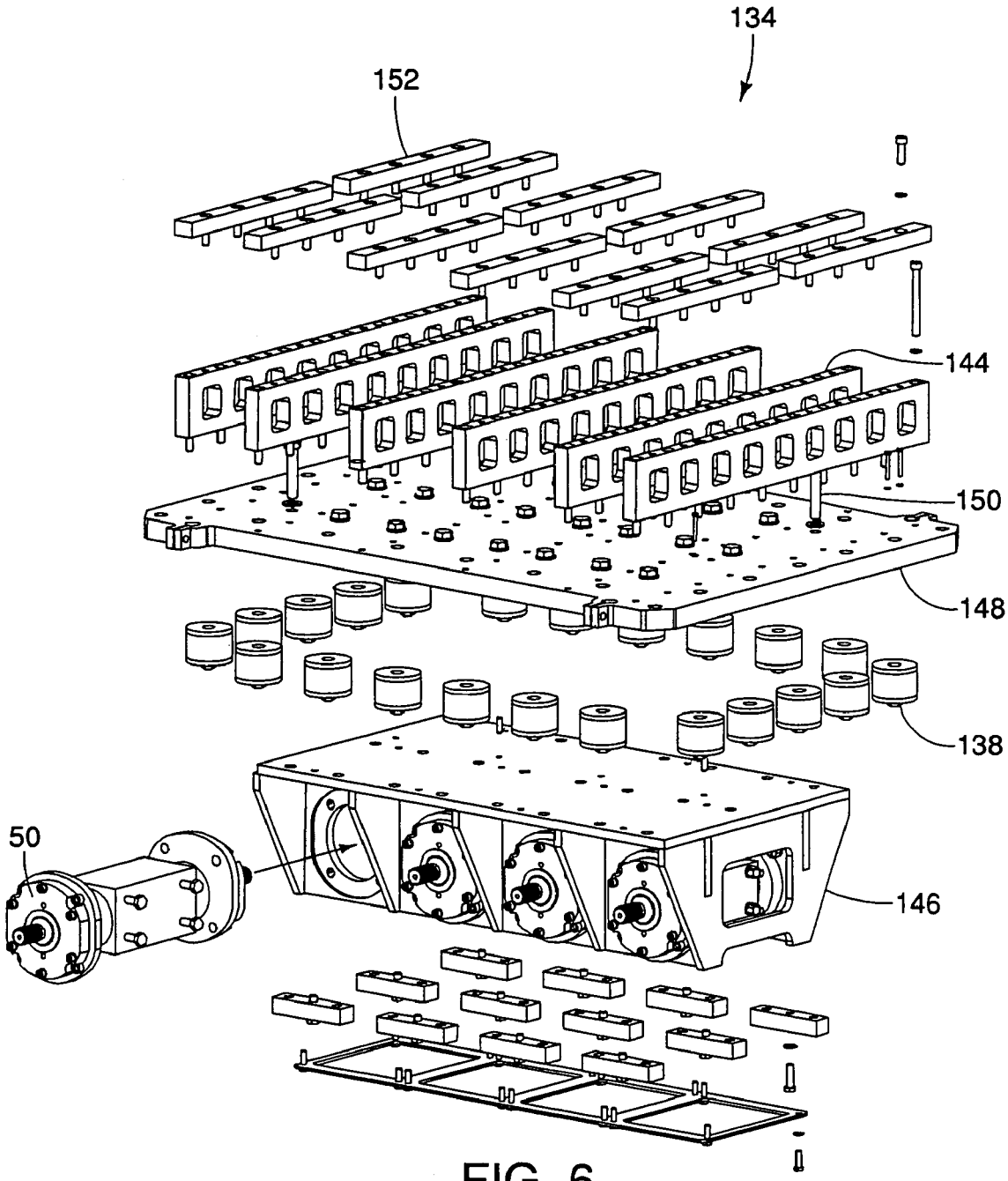
FIG. 6 is an exploded view of the pallet table vibration system of FIG. 5.

The vibration table 134 includes four motors with corresponding shafts assemblies 136*a*-136*d* that run nearly constantly at 2800-3000 rpm, each having an off-center weight thereon. In a preferred embodiment, the two outer shafts 136*a* and 136*d* counter-rotate and phase with one another; the two inner shafts 136*b* and 136*c* counter-rotate and phase with one another. FIG. 6 illustrates one of these motors (motor 50 containing shaft assembly 136*a*) exploded out from within a frame assembly 146 mounting the motors within the vibration table 134. When the phase difference between these rotating shafts 136*a*-136*d* is zero, as in FIG. 4A, maximum vibration arises. When the phase difference between the inner sets and the outer sets is 180 degrees, as in FIG. 4B, there is no vibration. All vibration would then be strictly controlled with phasing of the weights rather than varying the frequency, i.e., the rotation speed. A mid level vibration amplitude could be effected by phasing the inner two weights at 60-120 degrees to the outer two weights as shown in FIG. 4C. In this embodiment, the phase is changed only on the inner two weights by either speeding up or slowing down rotation momentarily to shift into a new phase. This phase-shifting can be accomplished much more quickly than speeding up and slowing down vibration, thus allowing quick changes in vibration amplitude and therefore keeping the product moving.

It is desired to have zero vibration when stripping the product from the mold. To achieve zero vibration, there must be both critical phase control and close mechanical tolerances of the weights and shafts. As shown in FIGS. 5 and 6, the pallet table rests on rubber pads 138 that smooths out the vibration process. The table is held in place by parallel leaf springs 140 (FIG. 2), which are affixed to each of the four corners of the pallet table, to maintain vibration strictly in the vertical direction.

Vibration of the mold is accomplished by shaking the mold from below rather than vibrating the mounts (such as shelves 120, 122) upon which the mold is mounted. In a preferred embodiment, the vibration assembly is formed generally of a fixed table and a cooperative vibrating table. Turning to FIG. 2, the fixed table includes a plurality of fixed bars 142 spanning the fixed table frame in spaced apart fashion. The vibrating table is mounted below the fixed table and includes similar elongate features, called moveable plates 144, which project up through the gaps between the fixed bars 142. The moveable plates 144 and therefore inter-leaved with the fixed bars 142.

That is, and as shown in FIG. 2, fixed bars 142 are positioned on top of the pallet table as part of the stationary frame and support the pallet during the mold process. Impact bars, formed by moveable plates 144 attached to the top of the vibration table 134, move vertically during the vibration cycle impacting the bottom of the pallet. The fixed bars 142, placed on edge are inter-leaved with moveable plates 144 (see, e.g. plates 144 in FIG. 5) also placed on edge; the movable plates being connected to the vibration table 134.

When the vibrating table is not in motion, fixed bars 142 form a base upon which the mold and pallet sits. When the vibrating table is in motion, as using the rotating counterweights discussed above, the moveable plates 144 move between lowered and raised positions. In the lowered position, the plates have top surfaces approximately level with the fixed plates 142. In the raised position, the top surface of the plates 144 are raised above the fixed plate level and accordingly impact against the underside of the pallet. This raises the pallet and mold, which then drops down to impact/land on the fixed plates with a vibration frequency and amplitude dictated by the vibration control mechanism described above. This high-speed movement creates the impact resulting in consolidation of the material within the mold cavities and removal of the voids and cavities that would ordinarily form within the product.

FIG. 6 shows the vibrator table in exploded view. Each of the four shaft assemblies 136 are mounted within a frame 146 which is coupled to bottom of plate 148 by a series of fasteners. Plates 144 are connected to a vibration table top plate 148 by a series of fasteners. Wear strips, such as strip 152, are fixed to the top of each plate 144. These wear strips impact the bottom of the pallet and are easily replaceable. Such strips 152 can also be removeably affixed to the top of the fixed bars 142. Accordingly, only the strips need be replaced once worn rather than the entirety of the bars/plates. The four motors (such as motor 50) and corresponding vibrator shaft assemblies are housed within the vibrator frame 146 which is fastened to the bottom of plate 148. The design of frame 146 effectively forms a gusset that increases the rigidity of the vibration table 134.

A plurality of rubber pads 138 are arranged about the periphery of vibration plate 148. The moveable plates 144 are connected along the width of the vibration plate 148 in a properly spaced apart fashion so as to project up through spaces created between fixed bars 142 on the fixed table. Vibration developed by controlling the phase of the vibrator counterweights results in a vertical up/down movement of the pallet table. This movement results in vibration of the mold.

Another new feature is the mist oil lubrication system, which lubricates a bearings on either end of the shaft (e.g., shaft 136*a*) supporting the off center weight. With this lubrication system, the oil is not re-circulated through the bearing. In this technique, only a very small amount of oil is used. Air is passed over the top of an oil reservoir to create air flow and localized depressurization that pulls oil from the surface of the reservoir and turns it into a mist. This mist, a mixture of air and fine oil particles, is then injected into each bearing of the vibration shaft assembly. The mixture of cool air, and oil, acts as a lubricant and coolant for the bearings and helps to increase bearing life.

Advantages of the misting oil lubricator constructed according to the present invention are several-fold. First, fresh oil is always being supplied to the bearings. A gravity drain reservoir at the bottom of the assembly 136 where the misted oil collects holds approximately a tablespoon of oil when condensed from the air. The oil is allowed to exhaust through a hose to a holding container. This system is fully automatic and incorporates safety devices that protect the machine in case of low oil conditions. This compares very favorably with the manual method used in prior machines where the bearings would need to be greased at least once a day.

The mold box is generally affixed to die supports, such as supports 120, 122 during the molding process. In previous systems, the mold box is not rigidly fixed to the die supports by bolting but rather held in place by air bags that allow the mold box to float. A known drawback to this technique is that the mold box shakes from side to side in addition to vertically. During the molding cycle the mold shoes pass into the mold cavities and compress the concrete therein. The clearances between the shoe assemblies and the mold cavities are fairly close tolerance. If the mold is not properly guided and during the vibration cycle is allowed to shake from side to side, these shoes can rub against the inside of the mold cavities resulting in premature wear to both the shoes and to the mold itself. Accordingly, the need exists to create a vibration system where mold vibration is limited to vertical movement only.

Figure 7:
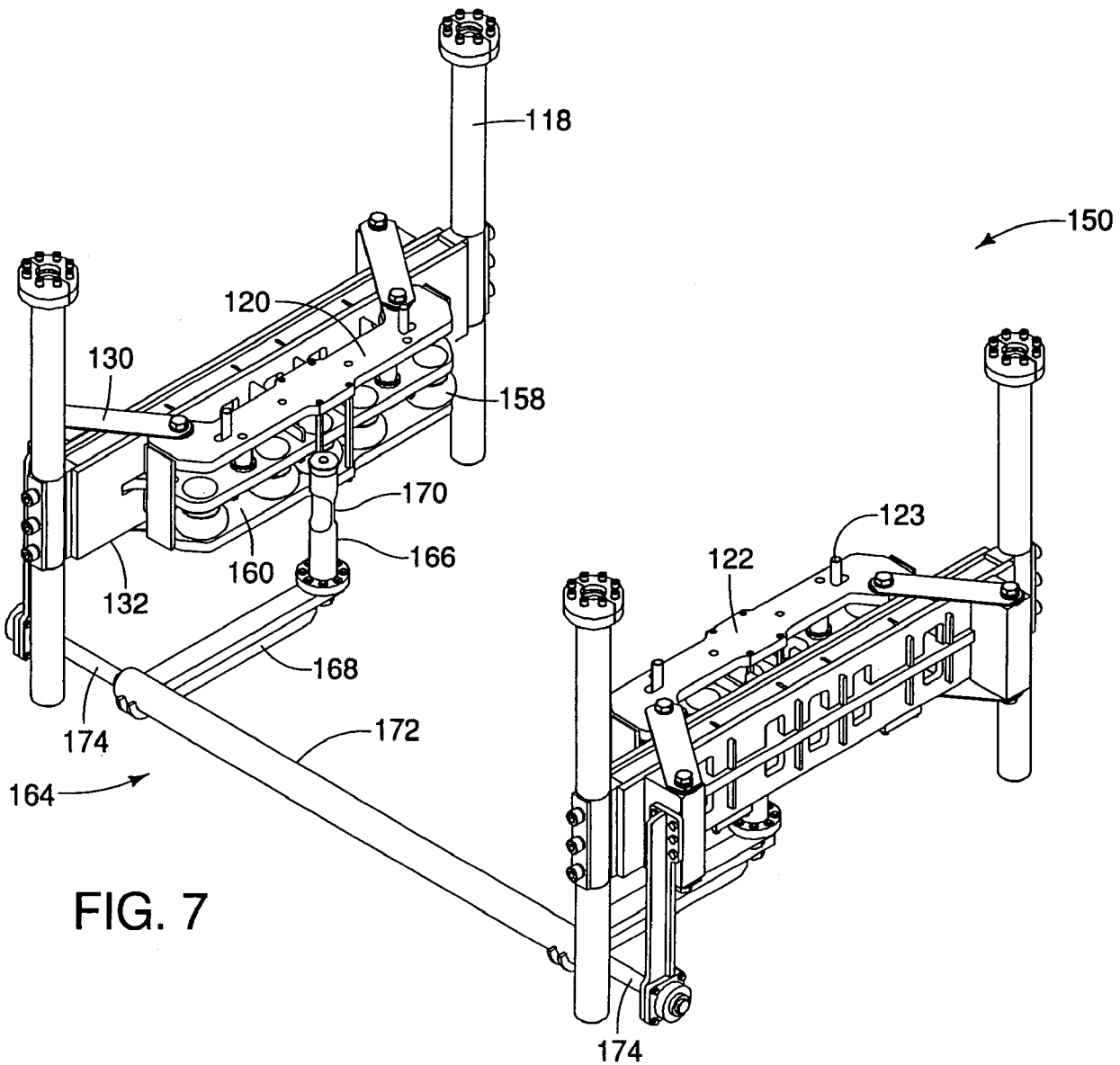
FIG. 7 shows in perspective view the vibration control system of the machine shown in FIG. 2 implemented according to a preferred embodiment of the invention to incorporate die supports and a torque tube stabilizer bar.

FIG. 7 illustrates a die support system integrated with the torque tube equalizer shaft assembly 164 of the molded products machine to form a vibration direction control apparatus 150 according to a preferred embodiment of the invention. As explained above, the mold box would span between each of the die supports 120, 122 and be rigidly coupled thereto as by through pins or bolts 123 projecting up from the die supports.

The vibration direction control apparatus 150 includes air springs within the die support. These air springs can be adjusted to control the pressure of the mold against the pallet. The die supports on each side are also connected with a torque tube 172 to maintain vibration in sync. In other words, this solid link between the die supports keeps them synchronized to ensure that both die supports, thus the mold box which sits upon them, moves uniformly in only a vertical direction.

The die support assembly 120, 122 is supported between two columns 118 received within the vertical support frame of the center section 102 (see FIG. 2). Four pairs of leaf springs, characterized by parallel upper and lower bars 130, 132, rigidly affix the die supports 120, 122 (FIG. 7) in an upright position allowing only vertical movement. These leaf springs are also referred to herein as parallel bars and exhibit substantially similar flexion under bias so that the attachment points at both ends are maintained in the same vertical plane throughout the flexion movement. The die support assembly 120, 122 includes a plurality of air bags 158 arranged in a line within a lower section thereof. The air bags 158 are maintained under a predetermined pressure to control the reaction of the die supports 120, 122 to the vibrational forces during the fill and compaction cycles. Adjusting air pressures would affect how much movement occurs within the mold and thereby affect the material compaction within the mold.

In a first novel feature, torsion elements comprising a pair of parallel bars 130, 132 are coupled between the main frame 110 of the apparatus and die supports 120, 122 for the mold box. Another pair of parallel bars 140 (FIG. 2) are coupled between the main frame corner posts 110 of the apparatus and the vibration table. There are a total of four pairs of each set, one for each corner of the apparatus. The result of this arrangement is to synchronize the vibration of both sides of the mold, and the die supports to which the mold is attached, in a strictly vertical direction.

Turning back to FIG. 7, a related novel feature is the torque tube equalizer shaft assembly 164. Such a shaft is rigidly coupled to an underside of, and spanning between, the two die supports. Whereas the parallel bars 130, 132 are intended to keep the die supports 120, 122 vibrating vertically, the torque tube equalizer shaft assembly 164 is coupled between the die supports and is intended to keep the die supports vibrating vertically and in unison. Vertical members (shaker shafts) 166 coupled to the underside of the die supports 120, 122 are linked to horizontal arms 168 that lead to the front of the machine. These shaker shafts are preferably formed with a relief 170 to allow a bit of flexion within the shafts. The torque tube 172 is then coupled between distal ends of these horizontal arms 168, spanning the front of the frame and also to stripper beams 116 (FIG. 2) of the frame via co-axial journals 174. In operation vibration imparted to one die support is communicated to the other die support through the torque tube to effect a more synchronized up-and-down movement of the die supports relative to the opposing die support, and thereby improving the vertical movement (e.g., limiting the tilting that occurs in prior art machines during the vibration process) by synchronizing the movement of one die support to the other.

Another feature is vibration of the mold head plate on the compression beam. Leaf springs 162 (FIG. 2) are also used to couple the head plate to the compression beam. Any vibrational forces imparted to the rest of the machine, and particularly to the head assemblies and shoes coupled thereto, from vibration table 134 would also vibrate in a generally vertical direction to again reduce the amount of wear on the shoes impacting against the interior walls of the mold assembly cavities. The use of these parallel bars assures that any movement that takes place within the head plate will be in a strictly vertical motion. Limiting movement to only vertical will improve alignment between the shoes of the head assembly and the mold cavities reducing the amount of wear to the cavities and the shoes themselves. A vibration source 129 (FIG. 8) is mounted to the top side of the head plate and can be used to vibrate the mold head assembly as needed to improve product surface finish.

Mold Change Feature

Reconfiguring the molded product machine 100 to produce differently shaped molded products (e.g., changing from rectangular blocks to hexagonal blocks) requires that the currently fitted mold assembly be changed out in favor of a new mold assembly. The new mold assembly would have differently shaped cavities, conforming to the type of block desired, and matching shoes that fit within the cavities mounted to the head assembly. A feature is desired to better automate or otherwise facilitate the mold change process since any downtime cuts in to the production efficiency of the machine. One such novel mold change feature, characterized by the assembly shown in FIGS. 8-12, is described below in reference to a preferred embodiment of the present invention.

Figure 8:
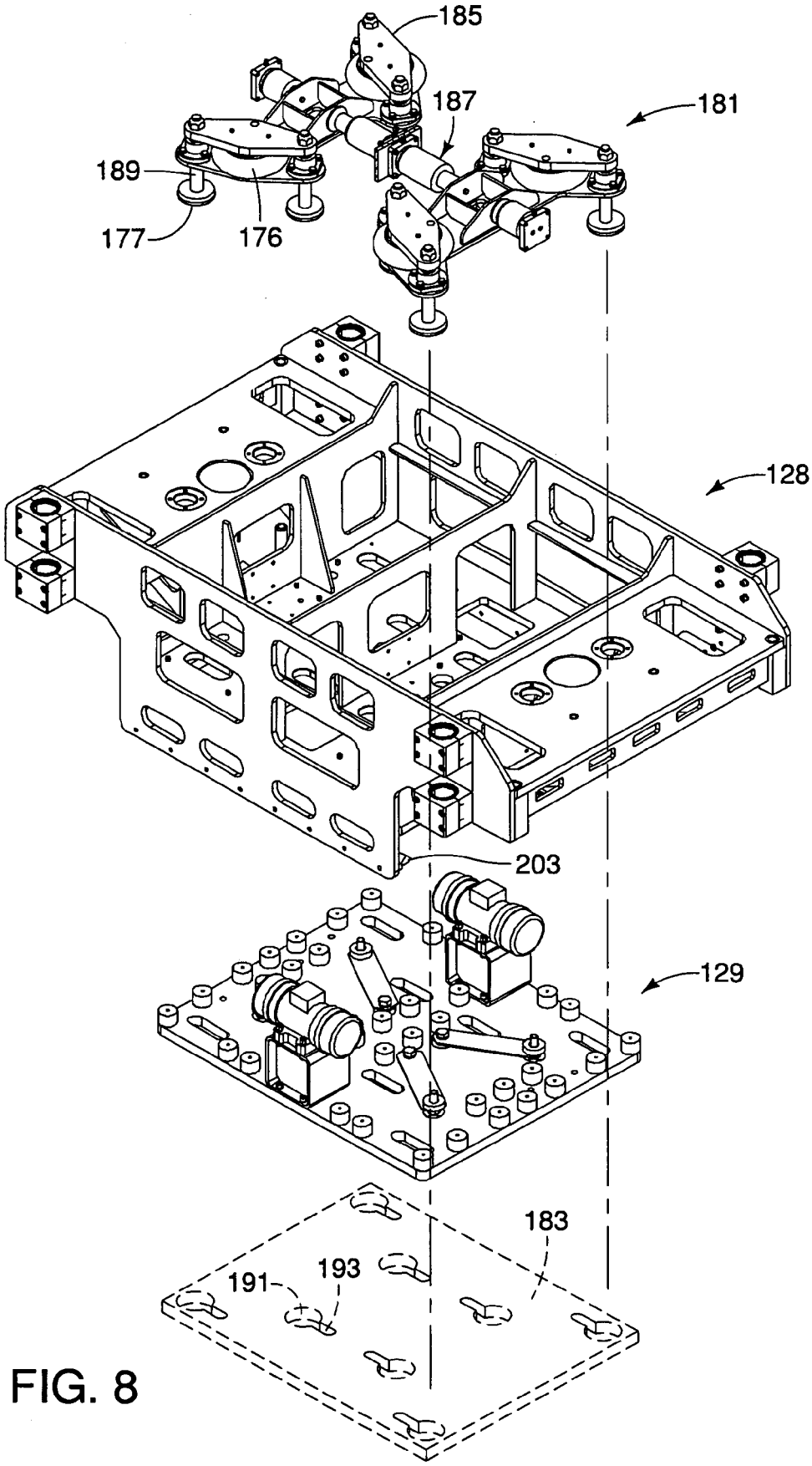
FIG. 8 is an exploded perspective view of the head assembly engagement structure according to a preferred embodiment of the invention shown in a disengaged position.
Figure 9:
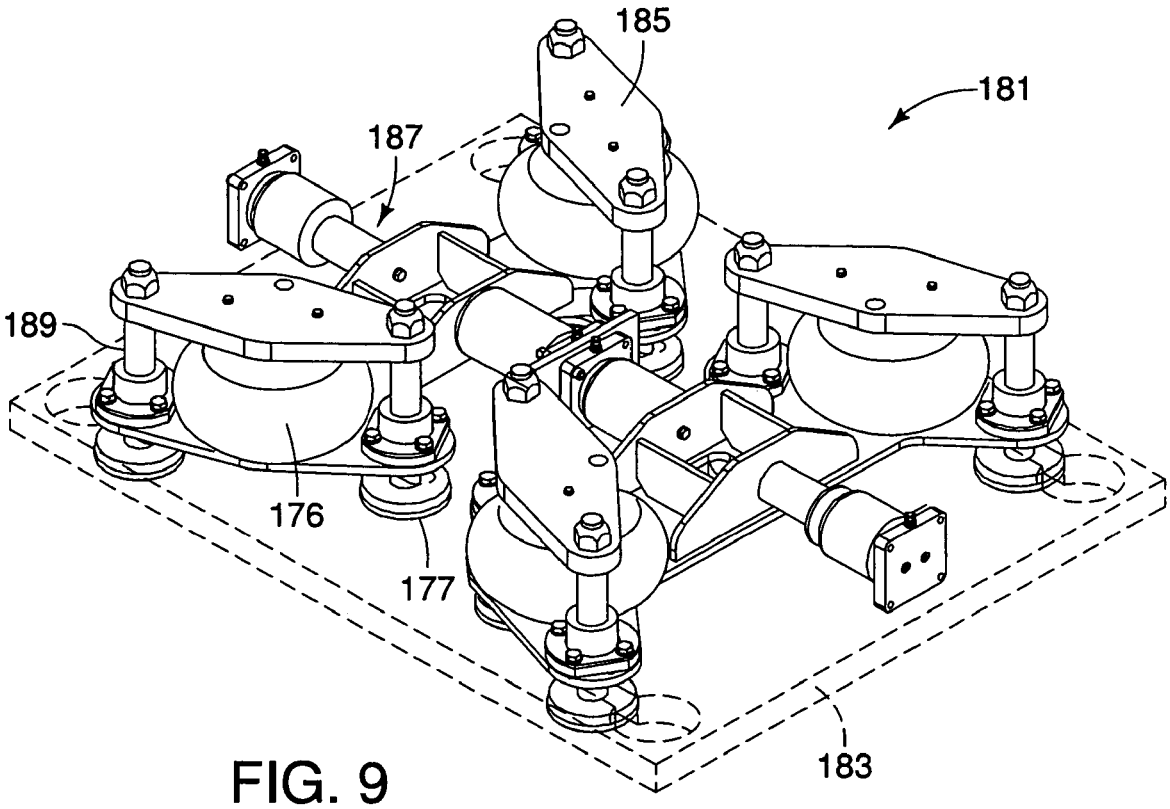
FIG. 9 is a perspective view of the head assembly engagement structure of FIG. 8 (with compression head removed) in an engaged position with the complementary key-slot features of a head assembly plate shown in dashed outline.

FIGS. 8-9 illustrate a compression beam assembly 128 and attached vibration source 129 incorporating a novel head clamp assembly 181. The combined system is shown in exploded view in FIG. 8 engaging with the top plate 183 of a head assembly. In general, the compression beam assembly would lower onto the head assembly, and the head clamp assembly 181 would operate as described below to couple the head assembly (via top plate 183) with the compression beam 128. The head assembly can thus be lifted from, and plunged into the mold cavities as needed to form the molded product as known in the art.

Head clamp assembly 181 is positioned within an upper cavity of the compression head 128. The head clamp assembly includes four sets of arms, such as arm 185. The arms 185 are mounted in sets with one set on the right side of the assembly 181, and the other on the left side. The arm sets are moveable relative to one another via pistons 187 or pneumatic means (such as airbags) so that the assembly 181 is in an expanded or compressed position. Furthermore, each arm includes a set of pins 189 with pucks 177 mounted on each end.

The mold head assembly is connected to the compression beam 128 via air springs and a key slot arrangement, which permits automated installation and retrieval of the mold from the center section. The pistons or pneumatic means 187 are positioned to move the head clamp assembly laterally once the mold head assembly is in position. That is, when the head clamp assembly 181 is in an expanded position as shown in FIG. 8, the pucks 177 are aligned with complementary keyhole structures 191 located on the head assembly top plate 183. Once the pucks 177 are moved downward into the keyhole 191, pistons or pneumatic means 187 are operated to compress the lateral dimension of the clamp assembly 181, thus moving the pins 189 toward the center along the slots 193 of the head assembly top plate 183. The airbags 176 on the clamp assembly 181 are then inflated to thus move the pucks 177 upward against the underside of the top plate 183 and snugly engage the top plate and thus the head assembly together with the compression beam. That is, this lateral movement aligns the head clamp pucks 177 in the proper position for alignment with the keyslots in the top of the mold head securing the head assembly to the compression beam. The air springs 176 are then actuated pulling the pucks up and moving the head assembly up against the head plate into its proper position for machine operation. These air springs stay initiated until a time when the mold head assembly would be removed and replaced. FIG. 9 shows the compression beam 128 in an engaged position with the head assembly (top plate 183) via the head clamp assembly 181.

The above head clamp assembly illustrates an automated method for coupling the head assembly with the compression beam of the concrete products forming machine 100. A reverse of the above would decouple the head assembly (via top plate 183) from the compression head 128. That is, the head assembly is lowered back into the aligned cavities of the mold assembly and then released. The compression beam then moves upward into a raised position so that the mold change carriage can operate as described below on mold assembly (e.g., mold and head assembly) to move it from out of the machine and replace it with another of a different configuration.

An electric drive characterized by rack and pinions 124, 126*a*, 126*b* (FIG. 2) provide for relative vertical movement of the compression beam, mold trolley carriage frame, mold box, and head assembly as necessary within the framework 110.

As a safety measure, a switch is located on the head clamps that alerts the operator if the clamps have moved off of the clamping position. If the machine loses air, the clamps will move away from the switch thereby forcing the machine to shut down. In the event that this happens the clamps can be reset with the clamp pucks moving the head assembly back in position against the head plate making the switch and allowing the machine to resume operation.

Figure 10:
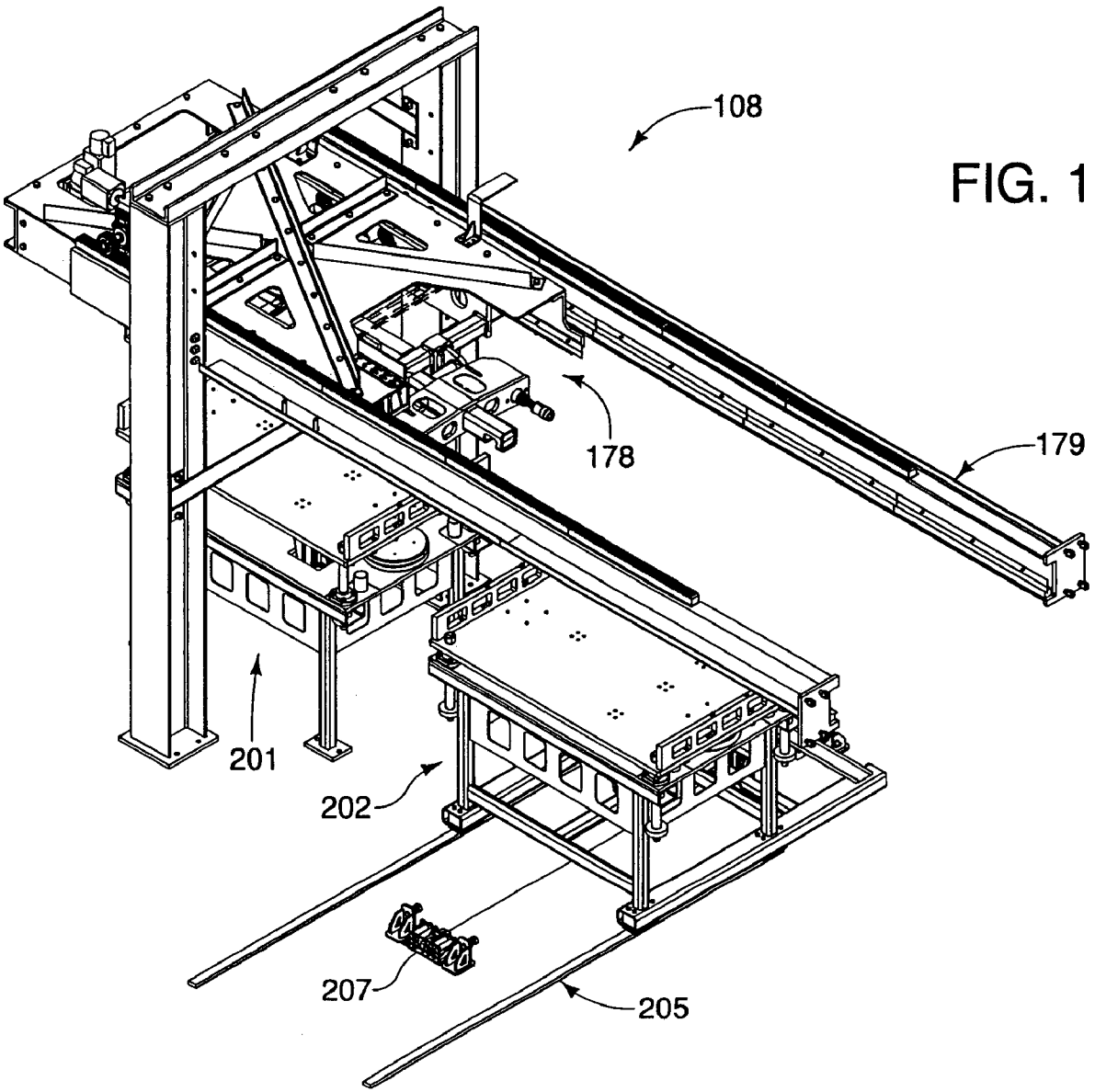
FIG. 10 shows in perspective view a mold change assembly implemented according to a preferred embodiment of the present invention and used in conjunction with the center section of the concrete products machine of FIG. 2.

FIG. 10 is a schematic view illustrating the mold transfer system 108 constructed according to a preferred embodiment of the invention. The head assembly and mold box are together laterally moved into and from the machine center section 102 with the mold trolley carriage frame shown in FIGS. 11 and 12 and described in detail below.

The mold transfer system 108 includes several elements including a set of overhead rails 179, a carriage 178 moving laterally along said rails 179, and two or more mold lift cart assemblies 201, 202. Rails 179 extend laterally away from the machine center section 102 to rail-like features 203 on the underside of the compression beam assembly 128 (FIG. 8). That is, the features 203 essentially extend the rails 179 so that the carriage 178 can move along the rails from outside the central section 102 to along the features 203 within the center section and just above the mold assembly 188. The carriage 178 engages and releases the mold assembly 188 as discussed below onto an empty lift cart assembly 202, and moves to the other assembly 201 (or vice versa) to pick up the other mold assembly. Assembly 202 runs along floor-mounted rails 205, via cable-pull motor 207 to move the lift cart assembly out of the way or into engagement position immediately below the rails 179.

Figure 11:
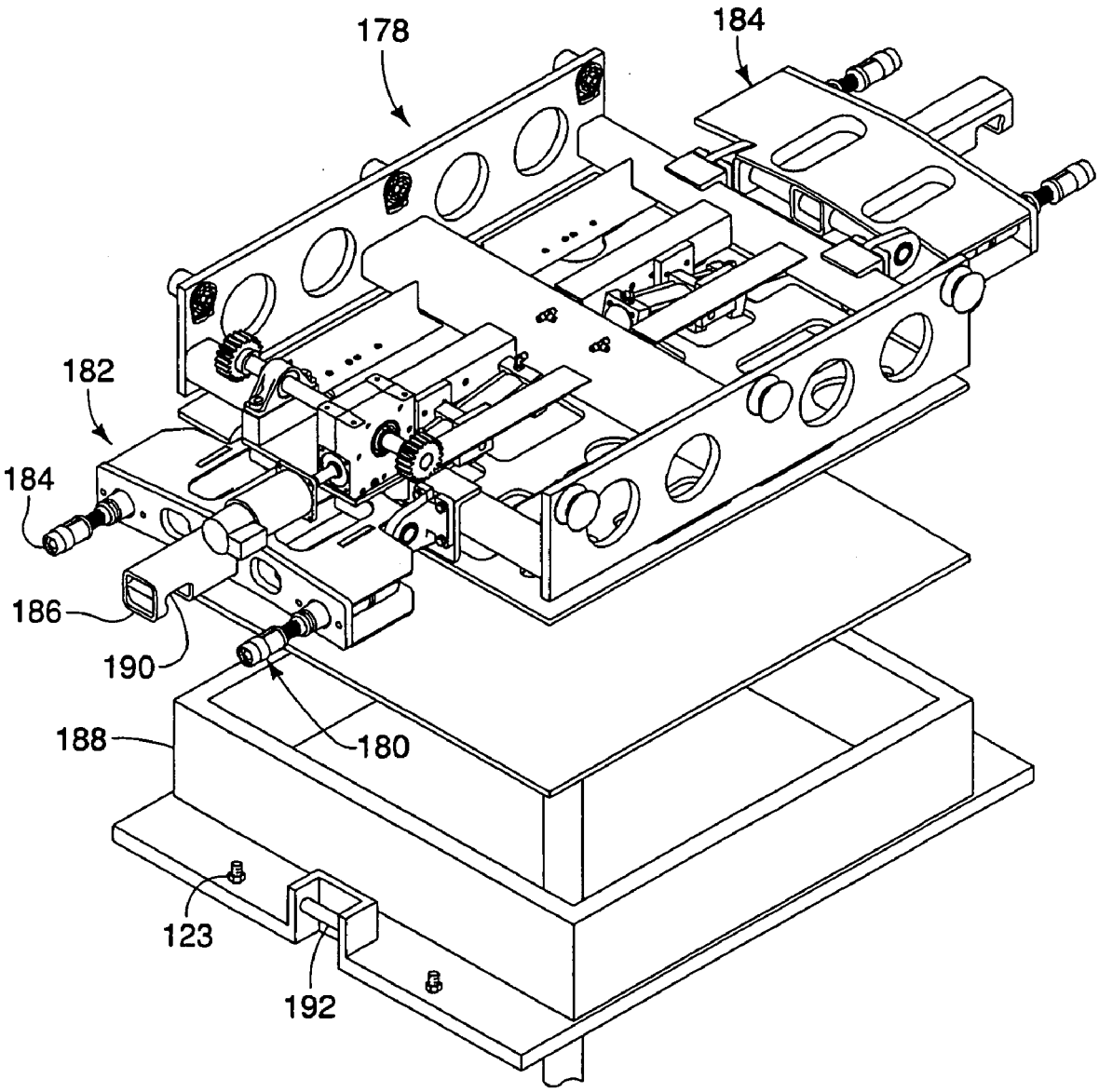
FIGS. 11-12 illustrate a mold carriage assembly constructed according to a preferred embodiment of the invention in perspective views in disengaged and engaged positions, respectively.

FIG. 11 illustrates a mold trolley carriage 178 constructed according to a preferred embodiment of the invention. Carriage 178 includes a wrench socket 180 having magnets therein to retain the nuts used to fasten the mold to the die supports 120, 122 (FIG. 2).

The mold trolley carriage 178 includes a pair of opposed pivoting arms 182, 184 (FIG. 11), each having automated nut drivers, like driver 180, thereon. A mold carrier member 186 on each of the wings engages mold box 188, as via a first feature on the mold carrier engaging a complementary feature on the mold box. In a preferred embodiment, and as shown in FIG. 11, an engagement slot 190 formed within the arm 182 receives a lifting bar 192 on mold box 188 to support the same. In an alternate embodiment, the first feature could be a pin and the second feature a hole/slot (or vice versa) so that the mold can be engaged by the downwardly pivoting arms and decoupled from the die supports on which it rests.

Figure 12:
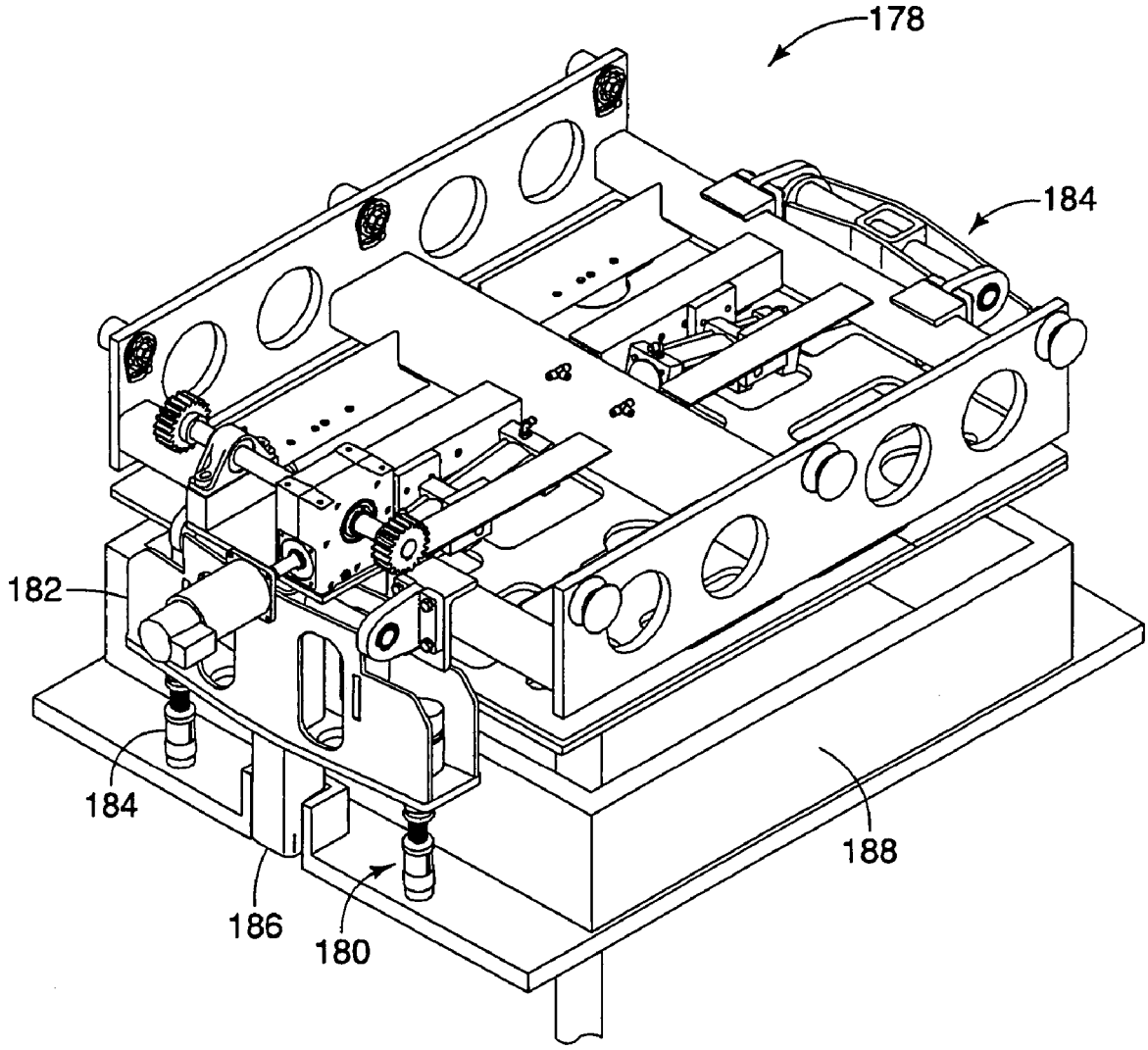

The mold transfer system, illustrated by the mold trolley carriage 178 in FIG. 12 operates as follows. A mold box, such as box 188 sits atop and is bolted to die supports 120, 122 as via bolts 123. The compression head 128 with the mold head assembly attached is lowered into the now empty mold and released by the air clamp system with key slots described above. The compression beam, without the head assembly attached, is then raised by rack and pinions to a predetermined position that will allow acceptance of the mold trolley carriage 178. The mold trolley carriage 178 is then laterally moved via a rail system 179 (FIG. 10) until it is properly positioned on the compression beam 128 (FIG. 11). The compression beam with the mold trolley carriage attached then lowers to a position that allows the carriage arms 182, 184 to swing down and be attached to the mold box 188. The automatic torque drivers 180 that are positioned on each swing arm then removes the nuts disengaging the mold box 188 from the die supports 120, 122 (FIG. 2). The sockets 184 on drivers 180 are sized to the specific nut. A feedback device (not shown) coupled to the drivers 180 measures the force applied to the nuts, as regulated by a PLC, and can determine whether there is a problem (e.g., the bolt snapped) during the installation or removal process of the nuts. The mold trolley carriage arms 182, 184 (particularly the mold carrier 186) engage with the mold box's engagement bar 192. The compression beam raises to the proper elevation that allows the mold trolley carriage to exit frame 110 (FIG. 2). The mold trolley carriage then moves out of the frame 110 and onto rail system 179 (FIG. 10) continuing until the carriage is in a predetermined position over the mold lift cart assembly 201 (FIG. 10). Once in position, the lift cart table 201 (FIG. 10) raises to an elevation that will allow the release of the mold assembly by raising the carriage arms 182, 184. Once the carriage arms have been raised to a horizontal position the carriage is moved to a position above the moveable lift cart assembly 202 (FIG. 10). The moveable lift cart assembly 202 has been previously fitted with the new mold/head assembly to be placed into the machine. The moveable lift cart assembly is moved to a position that places it under the mold carriage. The moveable lift table raises to allow the carriage arms to lower and attach to the new mold/head assembly. This new mold/head assembly is then transferred into the center section and installed in reverse fashion.

Feed Drawer Assembly

The description will next proceed to the feed drawer assembly. A feed drawer containing the material to be used within the mold assemblies to create molded product is mounted within a hoist system. The hoist includes a cart that may be raised or lowered along hoist rack members. A feed drawer 202 (FIG. 13) is placed within the cart of the hoist and moved laterally across a bottom plate 206 (FIG. 14) by a belt drive driven by an electric motor. In use, the cart is raised or lowered into proper position above the mold. As the cart carrying the feed box is moved laterally toward the mold, the concrete material within the feed box is dropped into the open top of the mold cavities.

Figure 13:
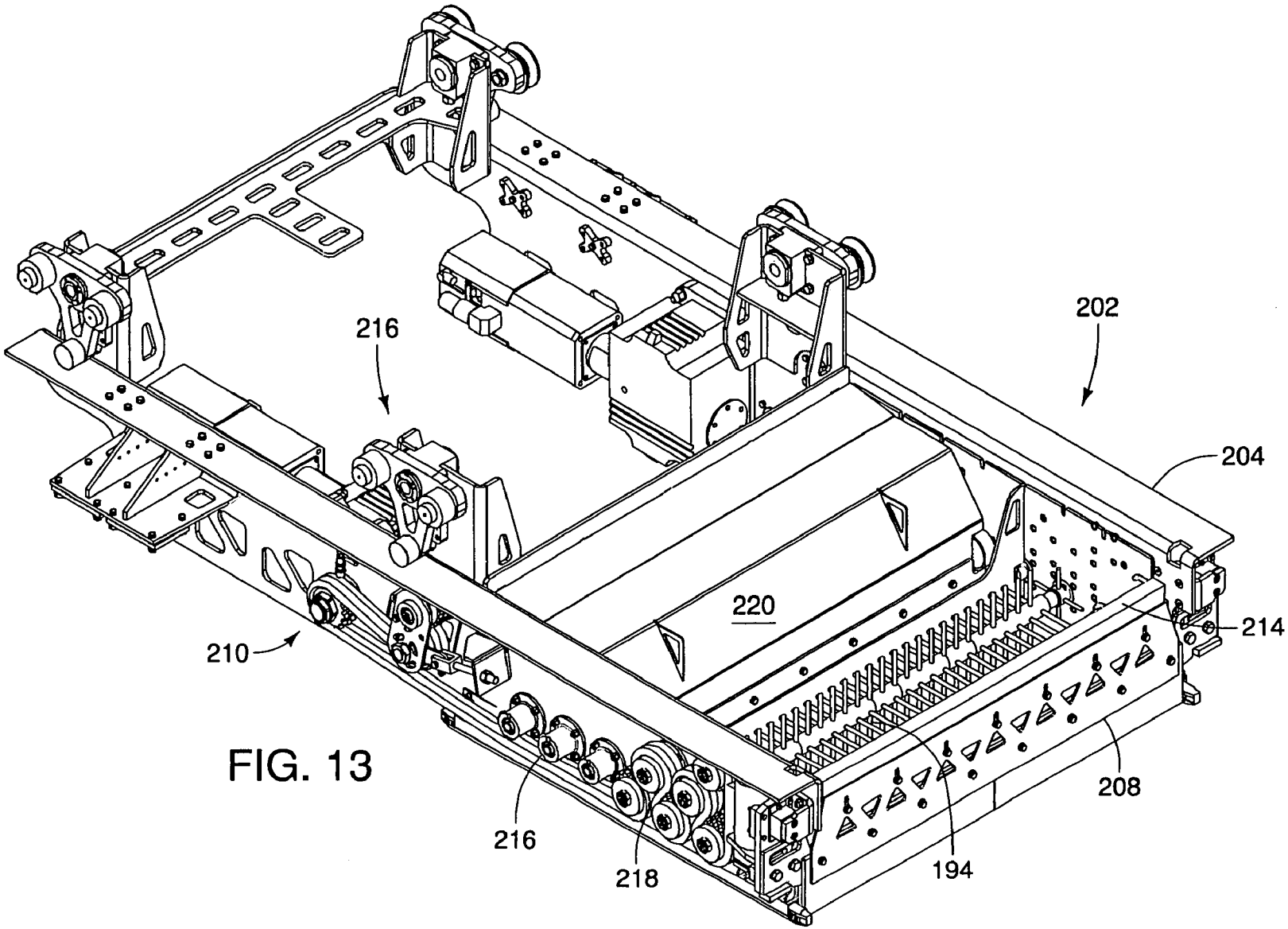
FIG. 13 shows a feed box in perspective view as implemented according to features of the present invention.
Figure 16:
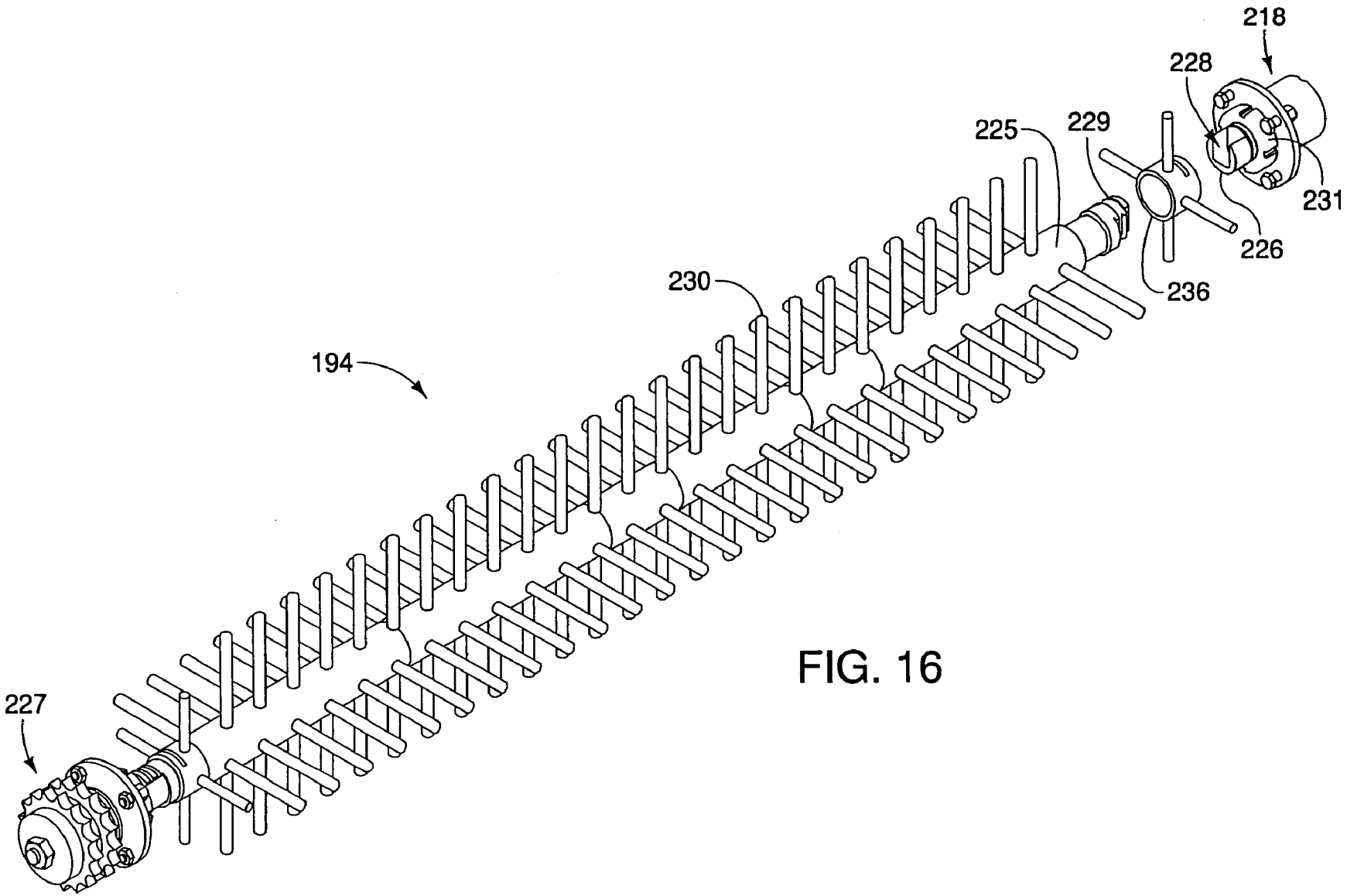
FIG. 16 is a perspective view illustrating a preferred implementation of an agitator assembly in partially exploded view with retainer clip.

Turning to FIG. 13, the feed drawer includes rotating agitators (such as agitator 194) that span the drawer side to side and can be replaced without tools, i.e., they can be easily removed from the feed drawer by removing a locking clip and sliding a retainer sleeve that locks the agitator shaft to the agitator retainer 226. More on this structure in a discussion of FIG. 16. There is also a baffle plate 220 available for the feed drawer that can be installed without tools. The baffles sit within the feed drawer and acts to reduce the feed drawer capacity, thereby reducing the amount of concrete mix the feed drawer can hold. As a result, there is less movement of the material within the drawer as the feed drawer moves laterally. The agitators, divided into two sets, are independently powered by servo motors and can be infinitely controlled in either direction. Power from the agitator motor and gearbox are transferred to the agitators via two chain drive systems 210 (the opposite side is not shown). Speed and direction of the agitators are controlled by the servo motors for purposes that are explained more fully below.

The feed drawer includes four walls 204 sitting on a stationary plate 206 of the hoist (FIG. 14) and includes an open top into which material is dumped as needed. A meter belt feed system positioned over the open top of the feed drawer dumps measured amounts of concrete material into the feed drawer during a drawer load process. The drawer is periodically emptied when the drawer walls move past the stationary plate whereby material kept within the walls flows through the now open floor of the mold and into the cavities of the mold box. As required, the feed drawer moves into the molding area of the machine and over the mold. As the feed drawer moves forward, the material from inside the feed box is delivered into the mold cavities. The material mounds up within the cavities. As the feed drawer is withdrawn, the lower edge of the front wall drags across the surface of the filled cavities thereby removing any excess material by dragging it back onto the hoist bottom plate 206 and into the feed box.

It has been observed in prior art systems that seepage of material sometimes occurs between the moveable walls of the feed box and the stationary plate serving as the feed box floor. The plate wears over time to create larger and somewhat uneven gaps between the wall bottoms and the plate.

The present invention presents features adapted to address this recognized drawback. FIGS. 15A-15E illustrate two embodiments of the invention adapted to seal against a bottom plate for the feed box assembly.

In a first, preferred embodiment (shown in FIGS. 15A and 15B), this sealing method, used on both the sides and the rear of the feed drawer, incorporates a bar 209 that is mounted on the feed box 202 and biased, as via springs 211 and 213 at each end of the metal strip, against the feed drawer bottom plate 206. A floating strip 215 on such a bar fills that the gap that would normally exist between the feed box and the feed drawer bottom plate. As the bar wears it will move down under the force of the spring to maintain the seal. In this preferred embodiment, the seal formed between the feed drawer 202 and bottom plate 206 is spring activated to form a seal between the moveable feed drawer and the stationary plate on which it sits. Each spring applies pressure to a floating seal strip 215 whose bottom surface is pressed under the spring-loaded biasing force against the feed drawer bottom plate, thereby closing any opening that would have otherwise formed between the feed drawer and plate. Irregularities in the surface of the plate are accommodated by the adjustability of the seal strip.

Figure 15A:
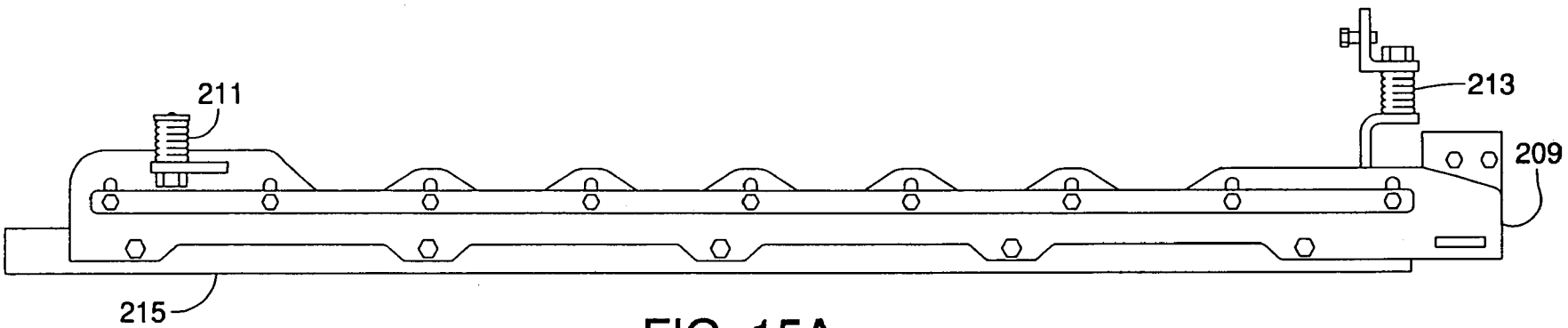
FIGS. 15A-15E illustrate a mold seal strip implemented according to two embodiments of the invention.
Figure 15B:
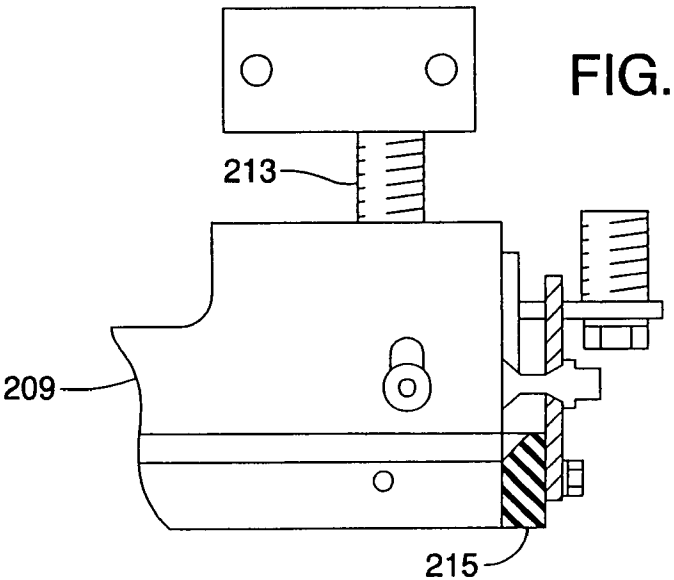
Figure 15C:
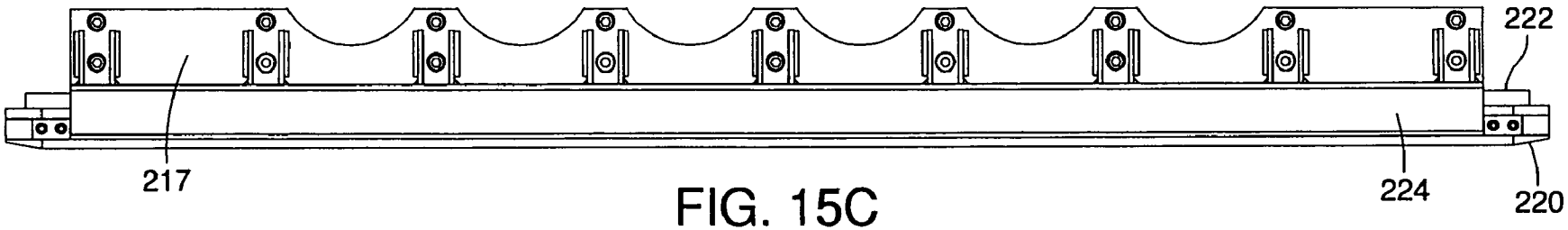
Figure 15E:
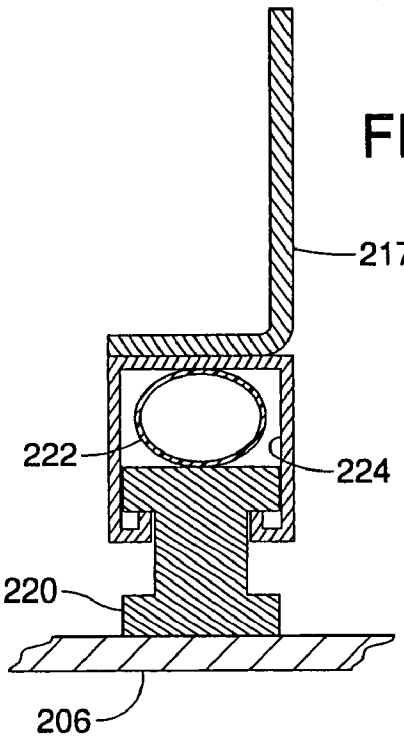
Figure 15D:
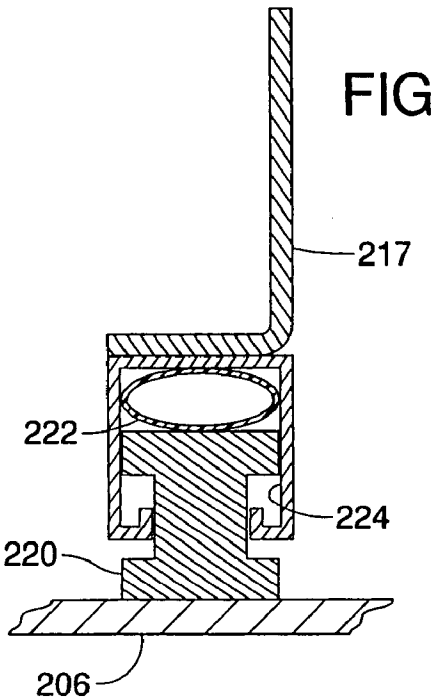

In another embodiment, shown in FIGS. 15C-15E, the seal is urged against a scraper/bar by air bags or springs, which keep the seal in place against the bottom plate 206 as it wears. A semi-flexible strip 220 across the bottom of the walls—preferably formed of UHMW—is affixed to the outside walls 204 (preferably the side and back walls) of the feed drawer 202 as via bracket 217. The strip 220 is biased against the plate 206 via a pneumatic tube 222 the bears across length of the UHMW strip.

FIG. 15D shows the pneumatic tube under low pressure with the bias force of the strip 220 against the plate 206 somewhat reduced. In contrast, FIG. 15E shows the pneumatic tube under high pressure with the bias force of the strip 220 against the plate 206 increased. In a preferred embodiment, the pneumatic tube is regulated with air at around five pounds per square inch. In the alternate implementation shown, strip 220 has an I-beam cross section and is slotted into a channel 224 with tube 222 received as well. As the tube 222 containing the air expands, a biasing force is applied along the length of the strip which bends as needed to seal against the uneven surface of a worn plate. UHMW also has another property that makes it an effective sealant; that is, concrete is found to not adhere well to the surface of UHMW thus reducing cleaning that would be required. The UHMW strip is also easily replaceable as it wears.

It is typically preferred that the top surface of the concrete material left within the mold have a smooth surface prior to compaction. Unfortunately, removal of the excess material using a strike off plate may cause surface break-off and uneven surfaces. To address the problem of surface break-off, the feed drawer includes a vibrating scraper bar 208, referred to in the art as a strike off plate, which is located on a front lower section of the feed drawer. The plate is coupled to vibration means comprising an electric motor with an unbalanced counterweight on it like a cam, which imparts vibratory forces to the plate and particularly the lower edge of the plate. As the feed drawer is withdrawn from over the mold, the vibrating scraper bar is drawn over the top of the mold to scrape the excess concrete material from the mold and level the top surface of the concrete being held within the mold cavities. The vibratory movement of the scraper bar acts to break the adhesive forces between the concrete surface and the bar, thus resulting in a smoother concrete top surface.

A brush 214 is fixed to the top surface of the strike-off plate 208 and has a function of wiping excess material from the bottom of the shoes as the feed drawer moves in and out over the mold. The feed drawer is supported by a series of rollers 216 in a manner that allows supporting of the feed drawer without having rails extend into the molding area of the machine. This feature becomes advantageous when it is necessary to physically access the center section of the machine. All functional movements of the machine are preferably electric or pneumatic. It is preferred that no hydraulic component be used on this machine.

Figure 14:
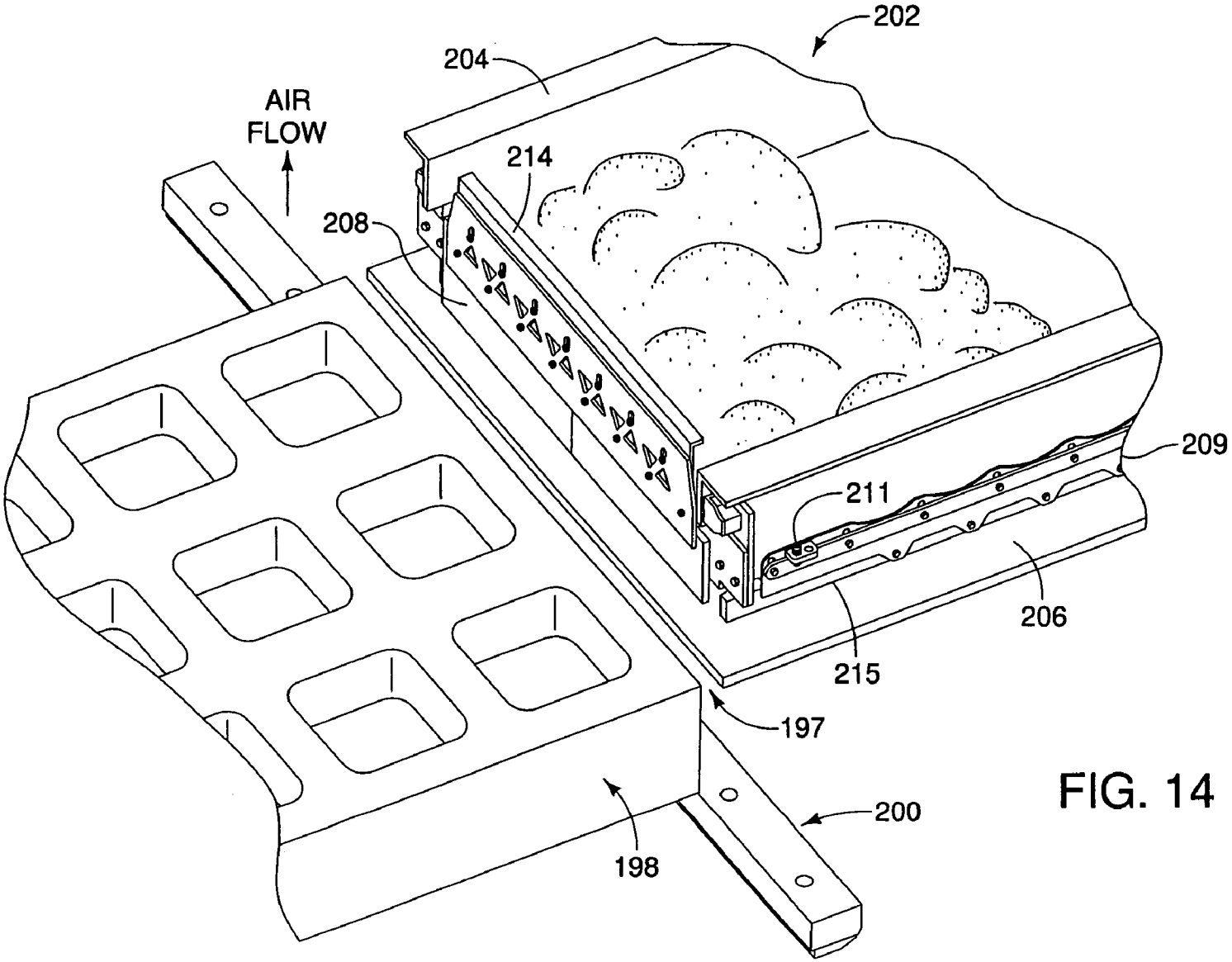
FIG. 14 illustrates the feed box of FIG. 13 in use to transport concrete the mold cavities.
Figure 17:
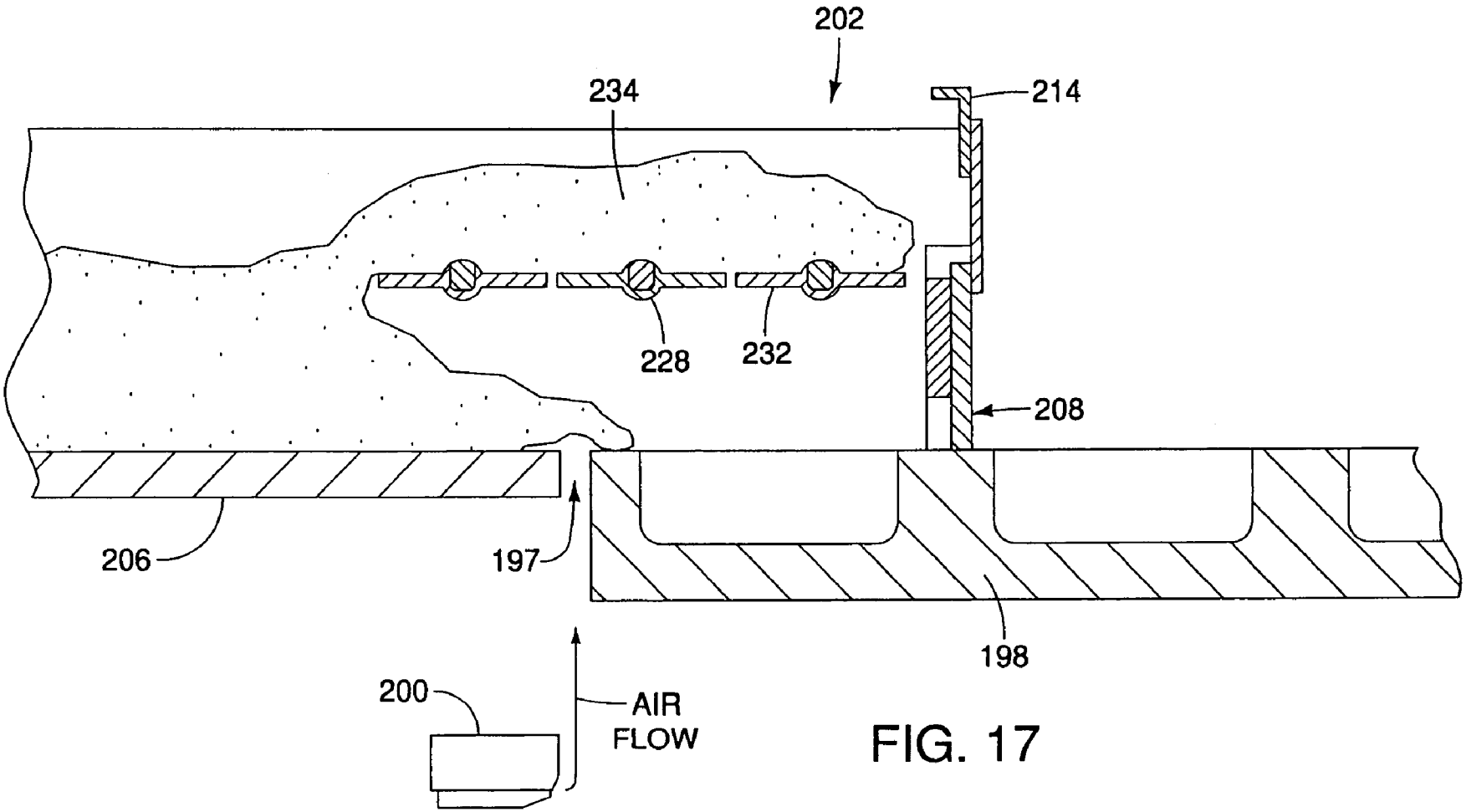
FIG. 17 is a side sectioned view of the feed box of FIG. 13 used to feed concrete into a mold with agitators moved into a first position to retain concrete above the floor of the feed box.

As shown best in FIGS. 14 and 17, there is also an air circuit device 200 that provides a barrier to prevent material in the feed drawer from falling into the gap 197 formed between the mold 198 and feed drawer bottom plate 206 as the feed drawer moves out across its bottom plate and over the mold. Air is delivered under pressure to an elongate cavity within the body of the air knife and forced through a slot formed along the length. The air emerges radially from the slot as a fine sheet under pressure and with great force. Though prior art air barriers that are used exclusively with gasses, that is to prevent air movement, but none to prevent movement of solid materials. Activation of the air circuit is indexed with the movement of the feed drawer via PLC or other means such that when the feed drawer moves forward off of its back switch the air circuit is activated and when the feed drawer is withdrawn completely back onto the switch the air circuit is deactivated. As shown best in FIG. 17, the air stream produced by the air knife acts to stop material within the feed drawer from falling into the gap 197 between the mold and the feed drawer bottom plate during the mold filling cycle. After a short time of operation a thin layer of dried concrete builds up on the front of the feed drawer bottom plate and acts to reduce the opening. If the dried concrete falls free the air stream once again acts to stop material.

In a preferred implementation, the feed drawer includes six rotary agitators 194 organized into two zones. An example of a preferred agitator 194 in shown in FIG. 16 and includes a shaft 225 on which are mounted fins and/or fingers 230 which mix the concrete materials as the shaft is rotated. The shaft is engaged at one end with a drive assembly 227 and an idler assembly 218 on the other end. In one embodiment, the front three actuator shafts are driven by servo motors 216 (FIG. 13) engaged with gears in synchronicity but independently of the back three actuator shafts. The shafts can be run at variable speeds or with varying phases to produce various material delivery effects that are discussed further below.

The rotating agitators implemented according to one preferred embodiment of the invention include solid fins 232 (e.g., FIG. 17) that extend therefrom that define what is referred to herein as a false bottom. The fins can be oriented in a horizontal direction to support product above the bottom plate 206 of the feed drawer so that a predetermined amount of concrete material 234 is elevated above the feed drawer plate. This allows material to be held in suspension and transported to the front of the mold prior to being dropped. To achieve this, the fins on the forwardmost portion of the feed drawer are maintained in a horizontal position forming a false bottom to maintain concrete mix on top thereof and then rotated to drop the mix after the drawer is in position over the mold box. Another effect is to drive the front agitators in a manner designed to sling material toward the front of the feed box so that the front is continually filled as the feed drawer moves over and fills the mold box cavities.

The agitators shown include a square end 229 that is received within a complementary square slot with open top 228 (FIG. 16) on the drives and idlers. A coupling sleeve 236 fitted on the ends of the agitator then slides over this square slot attaching with a little spring clip 231 that maintains the sleeve in position. No tools are necessary to install or remove the agitators. To remove, the spring clip is removed and the sleeve is slid inward so that it is not positioned over the drive assembly. Once the sleeve has been slid back, the agitator square end 229 can be removed from the open top 228 of the square slot 226 within the agitator retainer assembly 218.

Concrete tends to dry on the agitators creating a cleanup problem. The agitators are covered with a urethane sleeve, which has been found to reduce build-up agitators. Rotary agitators are included within the feed drawer and affixed at their ends to drive mechanisms mounted on the sides of the feed drawers. The agitators include rods and/or paddles that rotate within the concrete material as it is being delivered to the mold. The rotation of the agitators improves the filling of the mold cavities. The drive mechanism is driven by an electric motor located on the feed drawer behind the feed box.

The center section and the drawer feed section are preferably separate from one another. It is desirable to have the center section vibrate to compact product and to isolate the feed drawer from vibration to maintain the product in the "fluffiest" possible condition inside the drawer.

There can be a feed drawer on either end alternating over the mold. This facilitates either producing very large product, which requires two drawers full to make, or enables adding a colored cap to the top of the product.

Another aspect of the present design is modular construction. In other words, it is configured to add options easily without requiring modification or disposal of any of the existing system.

Having described and illustrated the principles of the invention in a preferred embodiment thereof, it should be apparent that the invention can be modified in arrangement and detail without departing from such principles. We claim all modifications and variation coming within the spirit and scope of the following claims.

What is claimed is:

1. An apparatus for vibrating a mold box of a type including a pallet supporting a bottom surface of the mold box, the apparatus comprising:

a vibration table comprising:

a plurality of moveable plates operable to reciprocate vertically between a lowered position immediately beneath the pallet supporting a bottom surface of the mold box, and a raised position at which position the moveable plates impact and lift upward an underside of the pallet supporting the bottom surface of the mold box; and a plurality of fixed bars, interleaved with said moveable plates, and mounted at approximately the lowered position, wherein the pallet impacted by the moveable plates and driven upward falls downward to impact against said fixed bars;

a pair of die supports located on either side of the moveable plates, the mold box being coupled to and spanning across the die supports;

a torque tube equalizer shaft assembly coupled between the die supports to help synchronize the movement of one die with the other during the vibration process; and a vibration direction control apparatus adapted to maintain said mold box to be vibrated in a generally vertical direction.

2. The apparatus of claim 1, wherein the vibration direction control apparatus includes a plurality of springs adapted to be affixed between the vibration table and a rigid frame surrounding said vibration table.

3. The apparatus of claim 2, wherein each of said springs includes first and second bars oriented parallel to one another in a vertical plane and exhibiting substantially similar flexion.

4. The apparatus of claim 2, the vibration direction control apparatus further comprising a second plurality of springs adapted to be affixed between the die supports and a rigid frame surround said die supports.

5. The apparatus of claim 4, further including a plurality of air bags arranged within a line and mounted within the die supports.

6. The apparatus of claim 5, wherein said air bags are maintained under a predetermined pressure to control reaction of the die supports to vibrational forces during the vibration process.

7. The apparatus of claim 2 operable on a molded products forming machine having a head assembly attached to a compression beam, wherein said head assembly includes shoes adapted to be received within complementary cavities formed within the mold, the apparatus for vibrating the mold box further including a plurality of springs coupled between the compression beam and the rigid frame.

8. The apparatus of claim 1, wherein the apparatus for vibrating the mold box is operable within a molded products forming machine of a type having a rigid frame, the vibration direction control apparatus including a plurality of springs adapted to be affixed between the die supports and the rigid frame surround said die supports, and a matching second plurality of springs coupled between the compression beam and the rigid frame.

9. The apparatus of claim 8, wherein the plurality of springs and the second plurality of springs each includes first and second bars oriented parallel to one another in a vertical plane and exhibiting substantially similar flexion.

10. The apparatus of claim 1, further including wear plates affixed to the top of each moveable plate and fixed bar.

11. The apparatus of claim 1, further including a plurality of shaft assemblies running parallel to one another, each having a counterweight mounted thereon and rotated with a phase relative to the other shaft assemblies sufficient to impart a measured vibration to the shaft assemblies.

12. The apparatus of claim 11, wherein the measured vibration is at a maximum when the shaft assemblies are rotated with a phase that is in phase with the other shaft assemblies.

13. The apparatus of claim 12, wherein the measured vibration is at a minimum when an equal number of the shaft assemblies are rotated with a phase that is opposite to a phase of the remaining shaft assemblies.

14. The apparatus of claim 1, further including a plurality of rubber pads arranged about a periphery of the apparatus and attached to an underside surface of the apparatus.

15. The apparatus of claim 1, said torque tube equalizer shaft assembly including vertical members coupled on one end to undersides of the die supports, horizontal arms running parallel to one another and coupled to other ends of the vertical members, and a torque tube coupled between the horizontal arms.

16. The apparatus of claim 15, further including reliefs formed in each of the vertical members to allow for some flexion in said vertical members.

17. An apparatus for vibrating a mold box of a type including a pallet supporting a bottom surface of the mold box, the apparatus comprising:

a plurality of moveable impact members operable to reciprocate vertically between a lowered position immediately beneath the pallet supporting a bottom surface of the mold box, and a raised position at which position the impact members impact and lift upward an underside of the pallet supporting the bottom surface of the mold box;

a plurality of fixed members, interleaved with said moveable members, and mounted at approximately the lowered position, wherein the pallet impacted by the impact members and driven upward falls downward to impact against said fixed members;

a pair of die supports located on either side of the impact members, the mold box being coupled to and spanning across the die supports;

a substantially rigid member coupled between the die supports to help synchronize the movement of one die with the other during the vibration process; and a vibration direction control apparatus adapted to maintain said mold box to be vibrated in a generally vertical direction.

18. The apparatus of claim 17, wherein the vibration direction control apparatus includes a plurality of springs operatively connected to the plurality of moveable impact members and a rigid frame adjacent the moveable impact members.

19. The apparatus of claim 18, wherein each of said springs includes first and second bars oriented parallel to one another in a vertical plane and exhibiting substantially similar flexion.

20. The apparatus of claim 18, wherein the vibration direction control apparatus further comprises a second plurality of springs adapted to be affixed between the die supports and a rigid frame surround said die supports.

21. The apparatus of claim 20, further including a plurality of air bags arranged within a line and mounted within the die supports.

22. The apparatus of claim 21, wherein said air bags are maintained under a predetermined pressure to control reaction of the die supports to vibrational forces during the vibration process.

23. The apparatus of claim 18 operable on a molded products forming machine having a head assembly attached to a compression beam, wherein said head assembly includes shoes adapted to be received within complementary cavities formed within the mold, the apparatus for vibrating the mold box further including a plurality of springs coupled between the compression beam and the rigid frame.

24. The apparatus of claim 17, wherein the apparatus for vibrating the mold box is operable within a molded products forming machine of a type having a rigid frame, a compression beam, and a head assembly attached to the compression beam, the vibration direction control apparatus including a plurality of springs adapted to be affixed between the die supports and the rigid frame surround said die supports, and a matching second plurality of springs coupled between the compression beam and the rigid frame.

25. The apparatus of claim 24, wherein the plurality of springs and the second plurality of springs each includes first and second bars oriented parallel to one another in a vertical plane and exhibiting substantially similar flexion.

26. The apparatus of claim 17, further including wear plates affixed to the top of each moveable and fixed member.

27. The apparatus of claim 17, further including a plurality of shaft assemblies running parallel to one another, each having a counterweight mounted thereon and rotated with a phase relative to the other shaft assemblies sufficient to impart a measured vibration to the shaft assemblies.

28. The apparatus of claim 27, wherein the measured vibration is at a maximum when the shaft assemblies are rotated with a phase that is in phase with the other shaft assemblies.

29. The apparatus of claim 28, wherein the measured vibration is at a minimum when an equal number of the shaft assemblies are rotated with a phase that is opposite to a phase of the remaining shaft assemblies.

30. The apparatus of claim 17, further including a plurality of rubber pads arranged about a periphery of the apparatus and attached to an underside surface of the apparatus.

31. The apparatus of claim 17, said substantially rigid member including vertical members coupled on one end to undersides of the die supports, horizontal arms running parallel to one another and coupled to other ends of the vertical members, and a torque tube coupled between the horizontal arms.

32. The apparatus of claim 31, further including reliefs formed in each of the vertical members to allow for some flexion in said vertical members.

* * * * *